US006492964B1

(12) United States Patent
Mikoshiba et al.

(10) Patent No.: US 6,492,964 B1
(45) Date of Patent: Dec. 10, 2002

(54) PLASMA DISPLAY PANEL AND DRIVING METHOD THEREOF

(75) Inventors: Shigeo Mikoshiba, Tokyo (JP); Jeong-duk Ryeom, Seoul (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/549,331

(22) Filed: Apr. 14, 2000

Related U.S. Application Data

(62) Division of application No. 09/081,827, filed on May 20, 1998.

(30) Foreign Application Priority Data

May 20, 1997 (KR) ..... 96-19554

(51) Int. Cl.[7] ..... G09G 3/28

(52) U.S. Cl. ..... 345/60; 345/63; 345/67; 315/169.4; 313/306; 313/309

(58) Field of Search ..... 345/60–68, 55, 345/103; 315/169.1–169.4; 313/306, 309, 336, 351

(56) References Cited

U.S. PATENT DOCUMENTS 4,044,349 A * 8/1977 Andoh et al. ..... 340/324
4,562,434 A * 12/1985 Amano ..... 340/775
4,629,942 A * 12/1986 Horio et al. ..... 315/169.4
4,638,218 A * 1/1987 Shinoda et al. ..... 315/169.4
4,737,687 A * 4/1988 Shinoda et al. ..... 315/169.4
5,030,888 A * 7/1991 Salavin et al. ..... 315/169.4
5,854,540 A * 12/1998 Matsutomu et al. ..... 315/169.1
5,995,069 A * 11/1999 Tokunaga et al. ..... 345/60
6,144,348 A * 11/2000 Kanazawa et al. ..... 315/168

* cited by examiner

*Primary Examiner*—Bipin Shalwala
*Assistant Examiner*—Jimmy H. Nguyen
(74) *Attorney, Agent, or Firm*—Lowe Hauptman Gilman & Berner, LLP

(57) ABSTRACT

A plasma display panel, one of flat panel display device, having improved electrical connections and the driving method thereof are disclosed. The plasma display panel and the driving method thereof have the advantage of diminishing the number of the high voltage driving ICs of high price by effectively constituting the connections of the discharge electrodes to diminish the number of the driving circuits. In addition, since the total scan electrodes are divided into two blocks, and are driven sequentially and alternately from a block to another, the influence of crosstalks by the leakage of the space charge may be diminished by disposing scan electrodes concurrently impressed with voltage signals to be relatively far apart.

7 Claims, 29 Drawing Sheets

PLASMA DISPLAY PANEL AND DRIVING METHOD THEREOF

This application is a Divisional of application Ser. No. 09/081,827 filed May 20, 1998.

BACKGROUND OF THE INVENTION

1. Field of the Invention

The present invention relates to a plasma display panel and the driving method thereof, and more particularly, to a plasma display panel, one of flat panel display devices, having improved electrical connections and the driving method thereof.

2. Description of the Related Art

Generally, to display an image on a flat panel display device, a matrix driving method is utilized. In this method, a pair of electrodes are sequentially selected among a plurality of scan electrodes arranged in the same horizontal direction as the scanning direction of a video signal and a plurality of address electrodes arranged in the vertical direction, and on the cross point of the pair of the electrodes, a video signal of a pixel can be displayed. In addition, two types of steps are required to display images on a flat panel display device. One step is an addressing step to sequentially address each one of pixels of the display panel, and the other one is a sustaining discharge step to display a video signal for a certain period of time at the corresponding pixel. In the plasma display panel, the two types of steps are carried out by selecting a pair of horizontal and vertical electrodes, and by establishing a negative glow discharge within a discharge space filled with a gas between the two electrodes. In other words, after a pair of scan electrodes and an address electrode are selected according to the sync pulses of a video signal, and a pulse voltage is impressed at least one of the electrodes to establish a gas discharge at the selected pixel, a pulse voltage is impressed across the scan electrodes to achieve a sustaining discharge, and therefore the video signal is transformed to a light signal and is displayed at the selected pixel.

The structural types of the plasma display panels are classified into a facing discharge type and a surface discharge type according to arrangement configurations of discharge electrodes, the driving types of the plasma display panels are classified into an AC driving type and a DC type according to whether the polarity of the voltage impressed for sustaining discharges is varying with the passage of time or not.

FIG. 1*a* shows a basic structure of a general DC type facing discharge plasma display panel, and FIG. 1*b* shows a basic structure of a general AC type surface discharge plasma display panel. As shown in FIGS. 1*a* and 1*b*, the DC type facing discharge plasma display panel, and the AC type surface discharge plasma display panel are respectively provided with discharge spaces 5 and 15 between front glass substrates 1 and 11 and back glass substrates 7 and 17. In the DC type plasma display panel, since a scan electrode 2 and an address electrode 6 are directly exposed to the discharge space 5, the flow of electrons supplied by a cathode is the energy source sustaining a discharge. In the AC type plasma display panel, since the scan electrodes 12 are embedded in a dielectric layer 13, they are electrically isolated from the discharge space 15. In this case, the discharge is sustained by the well-known wall charge effect. In addition, the AC type plasma display panels are classified into a facing discharge type and a surface discharge type according to the disposition of electrodes establishing discharges.

In the facing discharge plasma display panel, a pixel is addressed by the address electrode 6 on the back substrate 7 and the scan electrode 2 on the front substrate 1 which are disposed to face each other and to be orthogonal to each other and are addressed according to sync pulses of the video signal, and the discharge occurs and is sustained in the discharge space between the electrodes 2 and 6. In the surface discharge plasma display panel, a pair of the scan electrodes 12 formed on the front substrate 11 to be parallel to each other and the address electrode 16 formed on the back substrate 17 to be orthogonal with respect to the electrodes 2 and 6 are provided. In this panel, an address discharge occurs-between the address electrode 16 and the scan electrodes 12, and then a sustaining discharge to display a video signal occurs between two scan electrodes 12, namely, an X electrodes 12*a* and an Y electrodes 12*b*. Further, each type may employ 3 electrode structure, 4 electrode structure and so on including a plurality of scan electrodes and/or address electrodes in order to easily establish the discharge.

FIG. 2 shows a schematic exploded perspective view of an AC type 3 electrode surface discharge plasma display panel which is commercially available. An address electrode 16 and a pair of scan electrodes 12 to be orthogonal with respect to the address electrode 16 are disposed at both sides of a corresponding point of a discharge space 15. Partition walls 18 have roles to define discharge spaces 15 and to prevent cross talks between neighbor pixels from occurring by blocking space charges created during a discharge period and ultraviolet rays. To make a plasma display panel capable of displaying color images as a color display device, fluorescent materials 19 which can be excited by ultraviolet rays radiated during a discharge period and respectively emit visible light rays of red, blue, and green colors are respectively coated on the inside surfaces of the discharge spaces sequentially and repeatedly.

Such a plasma display panel coated with the fluorescent materials has to exhibit gray scale to achieve a preferable performance of a color image display device, and a gray scale exhibition method in which a image frame is divided into a plurality of subfields and the panel is driven in a time-division manner is currently utilized. FIG. 3 shows a diagram to explain a gray scale exhibition method of a general AC type plasma display panel. As shown in FIG. 3, the gray scale exhibition method of the AC type plasma display panel employs a method in which a image frame is divided into 4 subfields operated in a time-division manner and $2^4$=16 gray scale can be displayed. The operation period of each subfield consist of respective one of address periods A1 to A4 and respective one of sustaining discharge periods S1 to S4, the fact that the brightness perceived by human eyes is directly proportional to the relative duration of the sustaining discharge period is utilized to exhibit the gray scale. In other words, since the sustaining discharge periods S1 to S4 of a first subfield SF1 to a fourth subfield SF4 are in the ratio 1:2:4:8, combinational periods of each sustaining discharge period such as 0, 1 (1T), 2 (2T), 3 (1T+2T), 4 (4T), 5 (1T+4T), 6 (2T+4T), 7 (1T+2T+4T), 8 (8T), 9 (1T+8T), 10 (2T+8T), 11 (3T+8T), 12 (4T+8T), 13 (1T+4T+8T), 14 (2T+4T+8T), 15 (1T+2T+4T+8T) are possible and therefor 16 level gray scale can be displayed. For example, in order to display level 6 of the gray scale in a certain pixel, the second subfield 2T and the third subfield 4T have to be addressed, and in order to display level 15 of the gray scale, all of the first, second, third and fourth subfields have to be addressed.

FIG. 4 shows a diagram of an electrode connection scheme of an AC type 3 electrode surface discharge plasma display panel to realize the gray scale exhibition method as described above. As shown in FIG. 4, X electrodes 12*a* of scan electrodes 12 are connected to a common line, and accordingly a voltage signal of the same waveform including a sustaining discharge pulse is impressed to all the X electrodes 12*a*. Therefore, as a scan signal of the scan electrodes 12 is impressed to an Y electrode, an address discharge occurs between the Y electrode 12*b* and an address electrode 6, and then as a sustaining discharge pulse is impressed across the Y electrode 12*b* and the X electrodes, the display discharge is sustained. The waveforms of driving signals respectively impressed to the electrodes connected as described above are shown in FIG. 5.

In FIG. 5, A represents a driving signal to be impressed to each address electrode, X represents a driving signal to be impressed to each common electrode, i.e., X electrode 12*a*, and Y1 to Y480 represent driving signals respectively to be impressed to Y electrodes 12*b*. During a total erase period A11, in order to display an exact level of the gray scale, a total erase pulse 22*a* is impressed to the X electrode 12*a* to establish a strong discharge, and consequently a wall charge created by the previous discharge is erased, as shown in FIG. 6*a*, to make the following operation of subfields properly be carried out (the first step). During a total write period A12 and a total erase period A13, in order to lower an address pulse voltage, a total write pulse 23 is impressed to the Y electrode 12*b* and a total erase pulse 22*b* is impressed to the X electrode 12*a* to respectively establish a total write discharge and a total erase discharge, as shown in FIG. 6*b* and 6*c*, to control the amount of the wall charge within a charge space 15 (the second and third steps). During an address period A14, a selective 30 charge by an address pulse (a data pulse) 21 across an address electrode 16 and the scan electrode 12*b* which are orthogonal with respect to each other effects an operation to write, as shown in FIG. 6*d*, electrically coded information at a selected position of the plasma display panel (the fourth step). During sustaining discharge period S1, a sustaining discharge by a continuous sustaining discharge pulse 25 sustains a display discharge for a given period to display image information on an actual panel.

As described above, in the driving method of the AC type plasma display panel the electrodes of which are connected as shown in FIG. 4, since independent signals are inputted respectively to the Y electrodes 12*b* and the address electrodes 16 for address discharges as described above and display discharges to display image signals, each electrode requires a separate driving circuit. For example, a plasma display panel having 640×480 pixels requires one X electrode driving circuit and 480 Y electrode driving circuits, a total of 481 driving circuits for the scan electrodes. Usually, the driving circuit consists of an integrated circuit device incorporated with electronic circuit devices having at least one switch, and the integrated circuit device is referred to as a driver IC. The driver IC requires a high voltage due to the discharge characteristics, and especially since driver ICs used in the X and Y electrodes for display discharges requires a high voltage of about 200 V, it is required to use driver lCs of a very high price. Currently, since the price of the driving circuit portion forms a great part of the total cost of a plasma display panel, it is a decisive obstacles in the commercial success of the plasma display panel. To enhance the marketability of the plasma display panel, it is most important that the number of the driving circuit devices is reduced to lower the cost and the power consumption of the plasma display panel.

SUMMARY OF THE INVENTION

To solve the above problem, it is an objective of the present invention to provide a plasma display device having a reduced number of driving circuits for electrodes and a driving method thereof.

Accordingly, to achieve the above objective, there is provided an m×n matrix plasma display panel having m pairs of scan electrodes having m sustaining electrodes Y1, Y2, . . . , Ym and m common electrodes X1, X2, . . . , Xm which are arranged alternately and in parallel, and n data electrodes arranged to be orthogonal with respect to the m pairs of scan electrodes, wherein while the sustaining electrodes Y1, Y2, . . . , Ym are divided into i groups of electrodes and electrodes in each group are connected to a common line to form i groups of commonly connected Y electrodes, YY1, YY2, . . . , YYi, and the common electrodes X1, X2, . . . , Xm are divided into j groups of electrodes and electrodes in each group are connected to a common line to form j groups of commonly connected X electrodes, XX1, XX2, . . . , XXj, the scan electrodes are connected so that only one pair of an X electrode and an Y electrode among the i group of commonly connected Y electrodes, YY1, YY2, . . . , YYi and the j groups of commonly connected X electrodes, XX1, XX2, . . . , XXj may be arranged to neighbor with each other.

In the present invention, it is preferable that the number of scan electrodes, m, the number of groups of commonly connected Y electrodes, i, and the number of groups of commonly connected X electrodes, j, are in the relation of m=i×j, and when the number of the sustaining electrodes respectively connected to the groups of the commonly connected Y electrodes YY1, YY2, . . . , YYi is p and the number of the common electrodes respectively connected to the groups of the commonly connected X electrodes XX1, XX2, . . . , XXj is q, the scan electrodes are connected so that p, q, the number of groups of commonly connected Y electrodes, i, and the number of groups of commonly connected X electrodes, j are in the relation of i=q and j=p,) and the first group of the commonly connected Y electrodes, YY1 consists of electrodes Y1, Y2, . . . , Yp commonly connected thereto, the second group of the commonly connected Y electrodes, YY2 consists of electrodes Yp+1, Yp+2, . . . , Y2p commonly connected thereto, the third group of the commonly connected Y electrodes, YY3 consists of electrodes Y2p+1, Y2p+2, . . . , Y3p commonly connected thereto, and similarly, the ith group of the commonly connected Y electrodes YYi consists of electrodes Y(i−1)p+1, Y(i−1)p+2, . . . , Yip commonly connected thereto, and the first group of the commonly connected X electrodes, XX1 consists of electrodes X1, X1+j, X1+2j, . . . , X1+(q−1)j commonly connected thereto, the second group of the commonly connected X electrodes, XX2 consists of electrodes X2, X2+j, X2+2j, . . . , X2+(q−1)j commonly connected thereto, the third group of the commonly connected X electrodes, XX3 consists of electrodes X3, X3+j, X3+2j, . . . , X3+(q−1)j commonly connected thereto, and similarly, jth group of the commonly connected X electrodes, XXj consists of electrodes Xj, X2j, X3j, . . . , Xqj commonly connected thereto.

Further, in the present invention, it is preferable that when k is an integer, the m×n matrix plasma display panel consists of km'×n matrix having k display units of m'×n matrix arranged; each of the k display units having the same electrode connection schemes has i' sustaining electrode groups in each group of which one or p' neighboring sustaining electrodes are connected to each other; and when, in the k display units, a first display unit is expressed by subgroups of commonly connected Y'(1) electrodes, YY'1 (1), YY'2(1), . . . , YY'i'(1), a second display unit is expressed by subgroups of commonly connected Y'(1)

electrodes, YY'1(2), YY'2(2), . . . , YY'i'(1), and similarly, a kth display unit is expressed by subgroups of commonly connected Y'(k) electrodes, YY'1(2), YY'2(2), . . . , Y'i'(k), while the groups of commonly connected Y electrodes, YY1, YY2, . . . , YYi of the m×n matrix, each are expressed by respective subgroups, among the subgroups of the k display unit, a first group YY1 consists of subgroups YY'1(1), YY'1(2), . . . , YY'1(k) commonly connected thereto, among the subgroups of the k display unit, a second group YY2 consists of subgroups Y'2(1), Y'2(2), . . . , YY'2(k) commonly connected thereto, and similarly, among the subgroups of the k display unit, a ith group YYi consists of subgroups Y'i(1), YY'i(2), . . . , YY'i(k) commonly connected thereto.

Furthermore, in the present invention, it is preferable that in the k display units of m'×n matrix, the subgroups YY'1(1), YY'1(2), . . . , YY'1(k) each consists of Y1, Y2, . . . , Yp' commonly connected thereto, the subgroups YY'2(1), YY'2(2), . . . , YY'2(k) each consists of Yp'+1, Yp'+2, Yp'+3, . . . , Y2p' commonly connected thereto, the subgroups YY'3(1), YY'3(2), . . . , YY'3(k) each consists of Y2p'+1, Y2p'+2, Y2p'+3, . . . , Y3p' commonly connected thereto, and similarly, the subgroups Y'i'(1), YY'i'(2), . . . , YY'i'(k) each consists of Y(i'−1)p'+1, Y(i'−1)p'+2, Y(i')p'+3, . . . , Yi'p' commonly connected thereto; and when the number of common electrodes respectively connected to the groups of the commonly connected X' electrodes, XX'1, XX'2, . . . , XX'j' of the k display units of m'×n matrix is q', the first group of the commonly connected X' electrodes, XX'1 consists of electrodes X1, X1+j', X1+2j', . . . , X1+(q'−1)j' commonly connected thereto, the second group of the commonly connected X' electrodes, XX'2 consists of electrodes X2, X2+j', X2+2j', . . . , X2+(q'−1)j' commonly connected thereto, the third group of the commonly connected X' electrodes, XX'3 consists of electrodes X3, X3+j', X3+2j', . . . , X3+(q'−1)j' commonly connected thereto, and similarly, jth group of the commonly connected X' electrodes, XX'j' consists of electrodes Xj', X2j', X3j , . . . , Xq'j' commonly connected thereto, and thus the common electrodes are grouped so that the groups of the commonly connected X' electrodes in same order of each display unit may be sequentially or alternately driven.

In addition, to achieve the above objective, there is provided an m×n matrix plasma display panel having m"+2 scan electrodes and n data electrodes, wherein the 2 outmost electrodes at the one side among them"+2 scan electrodes are provided as preliminary discharge electrodes; while the m" scan electrodes consist of pairs of m" sustaining electrodes Y1, Y2, . . . , Ym" and m" common electrodes X1, X2, . . . , Xm", the sustaining electrodes are divided into i groups of commonly connected Y electrodes (Y1, Y2, . . . , Yp), (Yp+1, Yp+2, . . . , Y2p), . . . , (Ym"−p+1, Ym"−p+2, . . . , Ym"), each group consisting of p neighboring electrodes commonly connected thereto, and the common electrodes are divided into j groups of commonly connected X electrodes, (X1, X1+j, X1+2j, . . . , Xm"−j+1), (X2, X2+j, X2+2j, . . . , Xm"−j+2), . . . , (Xj, X2j, X3j, . . . , Xm"), each group consisting of q electrodes commonly connected thereto which each are at (j+1)th position from j common electrodes at one side.

In the present invention, it is preferable that the number of scan electrodes, m", the number of groups of commonly connected Y electrodes, i, and the number of groups of commonly connected X electrodes, j, are in the relation of m"=i×j and when the number of the sustaining electrodes respectively connected to the groups of the commonly connected Y electrodes YY1, YY2, . . . , YYi is p and the number of the common electrodes respectively connected to the groups of the commonly connected X electrodes XX1, XX2, . . . , XXj is q, the scan electrodes are connected so that p, q, the number of groups of commonly connected Y electrodes, i, and the number of groups of commonly connected X electrodes, j are in the relation of i=q and j=p. Alternatively, it is preferable that the number of scan electrodes, m", the number of groups of commonly connected Y electrodes, i, and the number of groups of commonly connected X electrodes, j, are in the relation of m"=i×j, when k is an integer, a m"×n plasma display portion of the (m"+2)×n matrix plasma display panel consists of km'×n matrix having k display units of m'×n matrix arranged; each of the k display units having the same electrode connection schemes has i' sustaining electrode groups in each group of which one or p' neighboring sustaining electrodes are connected to each other; and when, in the k display units, a first display unit is expressed by subgroups of commonly connected Y'(1) electrodes, YY'1(1), YY'2(1), . . . , YY'i'(1), a second display unit is expressed by subgroups of commonly connected Y'(1) electrodes, YY'1(2), YY'2(2), . . . , YY'i'(2), and similarly, a kth display unit is expressed by subgroups of commonly connected Y'(k) electrodes, YY'1(k), YY'2(k), . . . , YY'i'(k), while the groups of commonly connected Y electrodes, YY1, YY2, . . . , YYi of the m×n matrix, each are expressed by respective subgroups, among the subgroups of the k display unit, a first group YY1 consists of subgroups YY'1(1), YY'1(2), . . . , YY'1(k) commonly connected thereto, among the subgroups of the k display unit, a second group YY2 consists of subgroups YY'2(1), YY'2(2), . . . , YY'2(k) commonly connected thereto, and similarly, among the subgroups of the k display unit, a ith group YYi consists of subgroups YY'k(1), YY'k(2), . . . , YY'k(k) commonly connected thereto. Also, in the k display units of m'×n matrix, the subgroups YY'1(1), YY'1(2), . . . , YY'1(k) each consists of Y1, Y2, . . . , Yp' commonly connected thereto, the subgroups YY'2(1), YY'2(2), . . . , YY'2(k) each consists of Yp'+1, Yp'+2, Yp'+3, . . . , Y2p' commonly connected thereto, the subgroups YY3'(1), YY3'(2), . . . , YY3'(k) each consists of Y2p'+1, Y2p'+2, Y2p'+3, . . . , Y3p' commonly connected thereto, and similarly, the subgroups YY'i'(1), YY'i'(2), . . . , YY'i'(k) each consists of Y(i'−1)p'+1, Y(i'−1)p'+2, Y(i'−1)p'+3, . . . , Yi'p' commonly connected thereto; and when the number of common electrodes respectively connected to the groups of the commonly connected X' electrodes, XX'1, XX'2, . . . , XX'j of the k display units of m'×n matrix is q', the first group of the commonly connected X' electrodes, XX'1 consists of electrodes X1, X1+j', X1+2j, . . . , X1+(q'−1)j' commonly connected thereto, the second group of the commonly connected X' electrodes, XX'2 consists of electrodes X2, X2+j', X2+2j', . . . , X2+(q'−1)j' commonly connected thereto, the third group of the commonly connected X' electrodes, XX'3 consists of electrodes X3, X3+j', X3+2j', . . . , X3+(q'−1)j' commonly connected thereto, and similarly, ith group of the commonly connected X' electrodes, XX'j' consists of electrodes Xj', X2j', X3j', . . . , Xq'j' commonly connected thereto, and thus the common electrodes are grouped so that the groups of the commonly connected X' electrodes in same order of each display unit may be simultaneously driven by the same driving signal.

Further, in the present invention, it is preferable that when p=k=2, and the sustaining electrodes of the first display unit and the sustaining electrodes of the second display unit are respectively identified and represented by Y1, Y2, Y3, . . . , Yi' and Yi'+1, Yi'+2, Yi'+3, . . . , Y2i', the first group of the commonly connected Y electrodes, YY1 consists of electrodes Y1 and Yi'+1 commonly connected thereto, the second group of the commonly connected Y electrodes, YY2 consists of electrodes Y2 and Yi'+2 commonly connected thereto, the third group of the commonly connected Y electrodes, YY3 consists of electrodes Y3 and Yi'+3 commonly connected thereto, and similarly, the ith group of the commonly connected Y electrodes YYi consists of electrodes Yi' and Y2i' commonly connected thereto; and while the number of groups of commonly connected X electrodes, j must be an even number, the first group of the commonly connected X electrodes, XX1 consists of electrodes X1, X5, X2m'−4, and X2m' commonly connected thereto, the second group of the commonly connected X electrodes, XX2 consists of electrodes X2, X6, X2m'−5, and X2m'−1 commonly connected thereto, the third group of the commonly connected X electrodes, XX3 consists of electrodes X3, X7, X2m'−6, X2m'−2 commonly connected thereto, and similarly, jth group of the commonly connected X electrodes, XXj consists of electrodes Xj, Xj+4r, X2m'−j+1−4r, X2m'j+1 commonly connected thereto where r is a quotient obtained by dividing j by 4.

In addition, to achieve the above objective, there is provided a driving method of an m×n plasma display panel having m pairs of scan electrodes having m sustaining electrodes Y1, Y2, . . . , Ym and m common electrodes X1, X2, . . . , Xm which are arranged alternately and in parallel, and n data electrodes arranged to be orthogonal with respect to the m pairs of scan electrodes, where while the sustaining electrodes Y1, Y2, . . . , Ym are divided into i groups of electrodes and electrodes in each group are connected to a common line to form i groups of commonly connected Y electrodes, YY1, YY2, . . . , YYi, and the common electrodes X1, X2, . . . , Xm are divided into j groups of electrodes and electrodes in each group are connected to a common line to form j groups of commonly connected X electrodes, XX1, XX2, . . . , XXj, the scan electrodes are connected so that only one pair of an X electrode and an Y electrode among the i group of commonly connected Y electrodes, YY1, YY2, . . . , YYi and the j groups of commonly connected X electrodes, XX1, XX2, . . . , XXj may be arranged to neighbor with each other, wherein the driving method includes: an initialization step of completely erasing a wall charge created at subfield during a previous step; and an address discharge step of selecting and priming a pixel corresponding to image information, wherein the address discharge step includes the steps of: impressing sequentially to the groups of commonly connected X electrodes first pulses having an amplitude of a second voltage with reference to a first voltage of a reference voltage impressed to the scan electrodes, and a width smaller than that of the driving signal pulse of the data electrodes; and impressing sequentially to the groups of commonly connected Y electrodes second pulses having an amplitude of a third voltage having a polarity opposite to that of the second voltage with reference to a first voltage and a width of the period for which the first pulses are impressed once respectively to all the groups of commonly connected X electrodes.

In the present invention, it is preferable that while each pulse of the driving signal of the data electrodes is impressed later, with delay of a predetermined time, than each first pulse, the pulse of the driving signal of the data electrodes is impressed within at least 10 $\mu$ sec after the second pulses is divided by the same width of the first pulses and is impressed to the groups of commonly connected Y electrodes during the same period to correspond to each of the first pulses.

Further, in the present invention, it is preferable that in the address discharge step, a barrier voltage which has the same polarity of the first pulses and is lower than the second voltage is impressed between the first pulses impressed sequentially to each of the groups of commonly connected X electrodes, and it is also preferable that a sustaining discharge stabilizing pulse of a fourth voltage having a width narrower than that of sustaining discharge pulse is periodically impressed to the data electrodes during the sustaining discharge period.

In addition, to achieve the above objective, there is provided another driving method of an m×n matrix plasma display panel where an m×n matrix plasma display panel having m pairs of scan electrodes having m sustaining electrodes Y1, Y2, . . . , Ym and m common electrodes X1, X2, . . . , Xm arranged alternately and in parallel, and n data electrodes arranged to be orthogonal with respect to the m pairs of scan electrodes, is an 2m'×n matrix plasma display panel having 2 display units arranged each consist of m' pairs of scan electrodes having m' sustaining electrodes Y1, Y2, . . . , Ym' and m' common electrodes X1, X2, . . . , Xm' arranged alternately and in parallel; when sustaining electrodes and common electrodes of a first display unit of the 2 display units are expressed by Y1, Y2, . . . , Ym', and X1, X2, . . . , Xm', respectively and sustaining electrodes and common electrodes of a second display unit are expressed by Ym'+1, Ym'+2, . . . , Y2m', and Xm'+1, Xm'+2, . . . , X2m', while the sustaining electrodes of the 2 display unit are connected to each other to form groups of commonly connected Y electrodes YY1, YY2, YY3, . . . , YYi, respectively, a first group of commonly connected Y electrodes, YY1 consists of Y1 and Ym'+1 commonly connected thereto, a second group of the commonly connected Y electrodes, YY2 consists of electrodes Y2 and Ym'+2 commonly connected thereto, a third group of the commonly connected Y electrodes, YY3 consists of electrodes Y3 and Ym'+3 commonly connected thereto, and similarly, the ith group of the commonly connected Y electrodes YYi consists of electrodes Ym' and Y2m' commonly connected thereto, and while the common electrodes of the 2 display unit are connected to each other to form groups of commonly connected X electrodes XX1, XX2, XX3, . . . , XXi, respectively, the number of the groups of commonly connected X electrodes, j, must an even number, a first group of the commonly connected X electrodes, XX1 consists of electrodes X1, X5, X2m'−4, and X2m' commonly connected thereto, a second group of the commonly connected X electrodes, XX2 consists of electrodes X2, X6, X2m'−5, and X2m'−1 commonly connected thereto, a third group of the commonly connected X electrodes, XX3 consists of electrodes X3, X7, X2m'−6, X2m'−2 commonly connected thereto, and similarly, jth group of the commonly connected X electrodes, XXj consists of electrodes Xj, Xj+4r, X2m'j+1−4r, X2m'j+1 commonly connected thereto where r is a quotient obtained by dividing j by 4, wherein the driving method includes: an initialization step of completely erasing a wall charge created at subfield during a previous step; and an address discharge step of selecting and priming a pixel corresponding to image information, wherein the address discharge step includes the steps of: impressing alternately in sequential order and in reverse order of XX1, XXj, XX2, XX(j−1), XX3, XX(j−2), . . . to the groups of commonly connected X electrodes first pulses having an amplitude of a second voltage with reference to a first voltage of a reference voltage impressed to the scan electrodes, and a width smaller than that of the driving signal pulses of the data electrodes; and impressing sequentially to the groups of commonly connected Y electrodes second pulses having an amplitude of a third voltage having an polarity opposite to that of the second voltage with reference to a first voltage and a width of the period for which the first pulses are impressed once respectively to the 2 groups of commonly connected X electrodes.

In the present invention, it is preferable that wherein a sustaining discharge stabilizing pulse of a fourth voltage having a width narrower than that of sustaining discharge pulse is periodically impressed to the data electrodes during the sustaining discharge period.

In addition, to achieve the above objective, there is provided still another driving method of a plasma display panel having m"+2 scan electrodes and n data electrodes, where while among an m×n matrix plasma display panel having m" +2 scan electrodes and n data electrodes, the 2 outmost electrodes at the one side among the m"+2 scan electrodes are provided as preliminary discharge electrodes, and while the m" scan electrodes consist of pairs of m" sustaining electrodes Y1, Y2, . . . , Ym" and m" common electrodes X1, X2, . . . , Xm", the sustaining electrodes are divided into i groups of commonly connected Y electrodes (Y1, Y2, . . . , Yp), (Yp+1, Yp+2, . . . , Y2p), . . . , (Ym"−p+1, Ym"−p+2, . . . , Ym"), each group consisting of p neighboring electrodes commonly connected thereto, and the common electrodes are divided into j groups of commonly connected X electrodes, (X1, X1+j, X1+2j, . . . , Xm"j+1), (X2, X2+j, X2+2j, . . . , Xm'j+2), . . . , (Xj, X2j, X3j, . . . , Xm"), each group consisting of q electrodes commonly connected thereto which each are at (j+1)th position from j common electrodes at one side, wherein the driving method includes: an initialization step of completely erasing a wall charge created at subfield during a previous step; a step of impressing to the 2 preliminary discharge electrodes preliminary discharge pulses having a amplitude and a width same as those of the voltage of the initialization step utilizing the scan electrodes and a polarity opposite to that of it; and an address discharge step of selecting and priming a pixel corresponding to image information, wherein the address discharge step includes steps of: impressing sequentially to the groups of commonly connected X electrodes first pulses having an amplitude of a second voltage with reference to a first voltage of a reference voltage impressed to the scan electrodes, and a width smaller than that of the driving signal pulses of the data electrodes; and impressing sequentially to the groups of commonly connected Y electrodes second pulses having an amplitude of a third voltage having a polarity opposite to that of the second voltage with reference to a first voltage and a width of the period for which the first pulses are impressed once respectively to all the groups of commonly connected X electrodes.

In the present invention, it is preferable that each pulse of the driving signal of the data electrodes is impressed later, with delay of a predetermined time, than each first pulse, it is preferable that the second pulse which is divided by the same width of the first pulses and is impressed to the groups of commonly connected Y electrodes during the same period to correspond to each of the first pulses, it is preferable that total erase pulses impressed respectively to the groups of commonly connected X electrodes in the initialization step are impressed to them to be overlapped in the width of the preliminary discharge pulse for a certain period, it is preferable that in the address discharge step, a barrier voltage which has the same polarity of the first pulses and is lower than the second voltage is impressed between the first pulses impressed sequentially to each of the groups of commonly connected X electrodes, and it is preferable that a sustaining discharge stabilizing pulse of a fourth voltage having a width narrower than that of sustaining discharge pulse is periodically impressed to the data electrodes during the sustaining discharge period.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Now preferred embodiments of a plasma display panel according to the present invention and a driving method thereof are explained in detail with reference to the drawings.

The present invention proposes that in order to lessen the number of driving circuits of a plasma display panel driven by a pulse of an AC voltage, an electrode connection scheme of the plasma display panel is improved by utilizing the AND logic which is one of discharge characteristics, and a driving signal impressing method is designed to be appropriate to the improved connection scheme.

Namely, since X electrodes and Y electrodes are divided into groups to be connected to a common line, when pulses are sequentially impressed respectively to each group of X electrodes and Y electrodes for a corresponding pair of an X electrode and an Y electrode to be discharged, a space charge created at this moment may be used to prime a corresponding discharge space for an address discharge. In this case, the discharged pair of the X electrode and the Y electrode have a scanning function, and therefore each of address electrodes can address a signal to a desired discharge space. It is described in detail with respect to an embodiment as follows.

Figure 7:
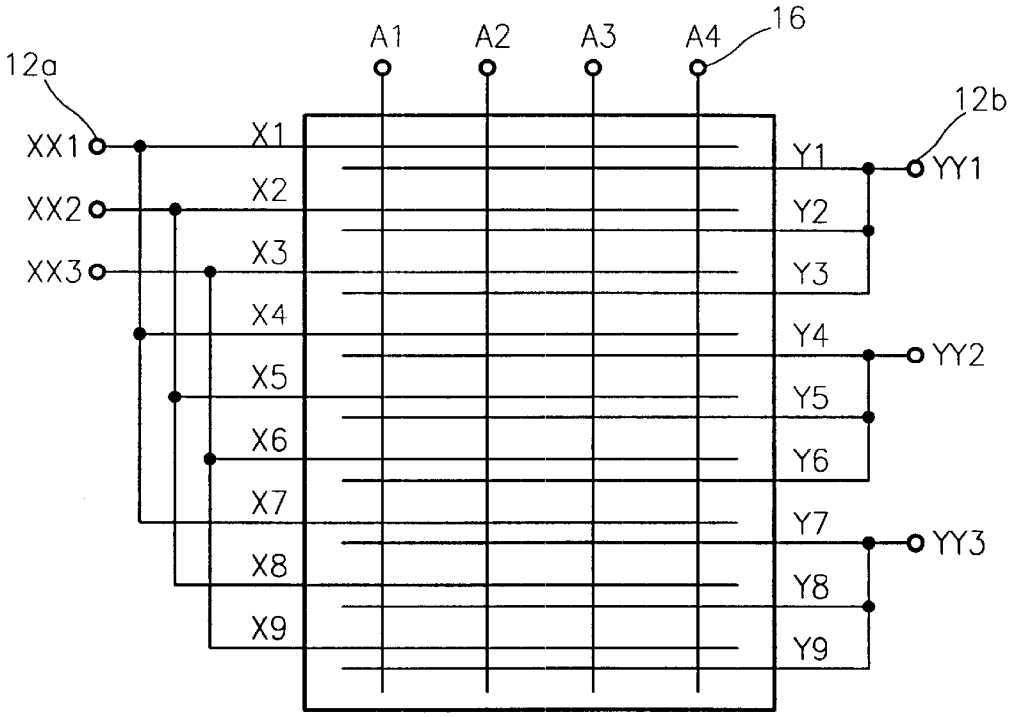
FIG. 7 is a diagram illustrating a first embodiment of an electrode connection scheme (i=q=j=p) of an AC type plasma display panel according to the present invention.

FIG. 7 shows a first embodiment of an electrode connection scheme as a diagram of an electrode connection scheme of an AC type plasma display panel according to the present invention.

The first embodiment, as shown in FIG. 7, is an electrode connection scheme in a plasma display panel provided with 9 X electrodes 12*a* and 9 Y electrodes 12*b* which all are scan electrodes. Here, Y electrodes 12*b* are divided into 3 groups of 3 commonly connected electrodes, YY1, YY2, and YY3. X electrodes corresponding to each one of Y electrodes of the groups of commonly connected electrodes YY1, YY2, and YY3 are sequentially grouped and connected to a common line to form 3 groups of 3 commonly connected electrodes, XX1, XX2, and XX3. Accordingly, when two groups, each selected respectively from the groups of commonly connected Y electrodes and the groups of commonly connected X electrodes are impressed by a proper voltage, only one pair of an X electrode and an Y electrode are impressed at the same time and in the pair of the X electrode and the Y electrode a discharge occurs to create a space charge. Then, when a proper voltage is impressed to one of address electrodes 16, the created space charge serves as a priming charge to facilitate a discharge by the address electrode 16. Scan electrodes are determined by a priming discharge of the selected pair of the X electrode and the Y electrode, an address discharge is induced to occur by the priming discharge, and a wall charge created by the address discharge induces a following display discharge. This means that the address discharge occurs according to the AND logic of the priming discharge by the pair of the X electrode and the Y electrode and the address discharge.

Figure 9:
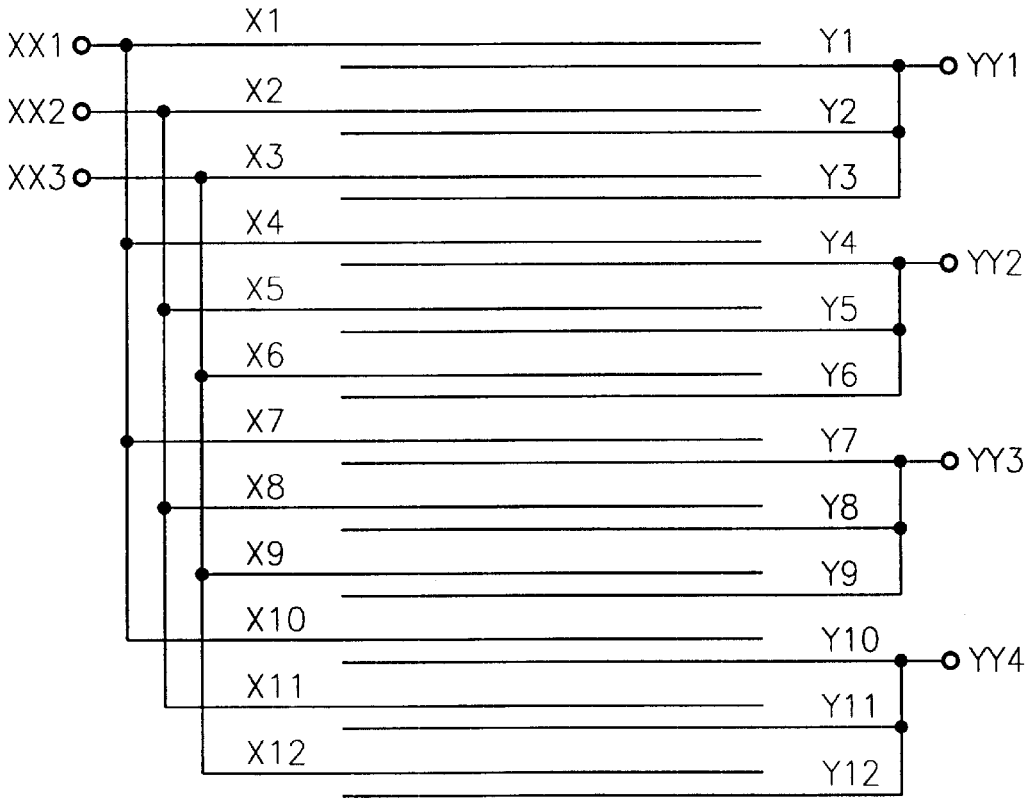
FIG. 9 is a diagram illustrating a second embodiment of an electrode connection scheme (i=q≠j=p) of an AC type plasma display panel according to the present invention.

FIG. 9 shows a second embodiment of an electrode connection scheme as a diagram of an electrode connection scheme of an AC type plasma display panel according to the present invention. The second embodiment, as shown in FIG. 9, is an electrode connection scheme in a plasma display panel provided with 12 X electrodes and 12 Y electrodes which all are scan electrodes. Here, Y electrodes are divided into 4 groups of 3 commonly connected electrodes, YY1, YY2, YY3, and YY4. X electrodes corresponding to each one of Y electrodes of the groups of commonly connected electrodes YY1, YY2, YY3, and YY4 are sequentially grouped and connected to a common line to form 3 groups of 3 commonly connected electrodes, XX1, XX2, and XX3. Accordingly, when two groups, each selected respectively from the groups of commonly connected Y electrodes and the groups of commonly connected X electrodes are impressed by a proper voltage, only one pair of an X electrode and an Y electrode are impressed at the same time.

The electrode connection schemes of the first and second embodiments have following general features.

When a plasma display panel is an m×n matrix plasma display panel having m pairs of scan electrodes having m sustaining electrodes Y1, Y2, . . . , Ym and m common electrodes X1, X2, . . . , Xm which are arranged alternately and in parallel, and n data electrodes arranged to be orthogonal with respect to the m pairs of scan electrodes, the sustaining electrodes Y1, Y2, . . . , Ym are divided into i groups of electrodes and electrodes in each group are connected to a common line to form i groups of commonly connected Y electrodes YY1, YY2, . . . , YYi, and the common electrodes X1, X2, . . . , Xm are divided into j groups of electrodes and electrodes in each group are connected to a common line to form j groups of commonly connected X electrodes XX1, XX2, . . . , XXj. Here, it is a characteristic that the scan electrodes are connected so that only one pair of an X electrode and an Y electrode among the i groups of commonly connected Y electrodes YY1, YY2, . . . , YYi and the j groups of commonly connected X electrodes XX1, XX2, . . . , XXj may be arranged to neighbor with each other.

In the case that the electrodes are disposed as described above, it is preferable that the number of scan electrodes, m, the number of groups of commonly connected Y electrodes, i and the number of groups of commonly connected X electrodes, j are in the relation of m=i×j.

In addition, when the number of the sustaining electrodes respectively connected to the groups of the commonly connected Y electrodes YY1, YY2, . . . , YYi is p and the number of the common electrodes respectively connected to the groups of the commonly connected X electrodes XX1, XX2, . . . , XXj is q, it is preferable that the scan electrodes are connected so that p, q, the number of groups of commonly connected Y electrodes, i, and the number of groups of commonly connected X electrodes, j are in the relation of i=q and j=p.

The cases that the relation can be true are the case of the first embodiment, as shown in FIG. 7, where the relation between them is i=q=j=p, and the case of the second embodiment, as shown in FIG. 9, where the relation between them is i=q≠j=p. Here, the first embodiment is the case of i=q=j =p and m=9, and the second embodiment is the case of i=q=4, j=p=3 and m=12.

The characteristics of the above electrode connections are generally expressed as follows.

In a plasma display panel is an m×n matrix plasma display panel having m pairs of scan electrodes having m sustaining electrodes Y1, Y2, . . . , Ym and m common electrodes X1, X2, . . . , Xm which are arranged alternately and in parallel, and n data electrodes arranged to be orthogonal with respect to the m pairs of scan electrodes, when the sustaining electrodes Y1, Y2, . . . , Ym are divided into i groups of electrodes and electrodes in each group are connected to a common line to form i groups of commonly connected Y electrodes YY1, YY2, . . . , YYi, and the common electrodes X1, X2, . . . , Xm are divided into i groups of electrodes and electrodes in each group are connected to a common line to form j groups of commonly connected X electrodes XX1, XX2, . . . , XXj, the first group of the commonly connected Y electrodes YY1 consists of electrodes Y1, Y2, . . . , Yp commonly connected thereto, the second group of the commonly connected Y electrodes YY2 consists of electrodes Yp+1, Yp+2, Yp+3, . . . , Y2p commonly connected thereto, the third group of the commonly connected Y electrodes YY3 consists of electrodes Y2p+1, Y2p+2, Y2p+3, . . . , Y3p commonly connected thereto, and similarly, the Ah group of the commonly connected Y electrodes YYi consists of electrodes Y(i−1)p+1, Y(i−1)p+2, Y(i−1l)p+3, . . . , Yip commonly connected thereto. In addition, the first group of the commonly connected X electrodes XX1 consists of electrodes X1, X1+j, X1+2j, . . . , X1+(q−1)j commonly connected thereto, the second group of the commonly connected X electrodes XX2 consists of electrodes X2, X2+j, X2+2j, . . . , X2+(q−1)j commonly connected thereto, the third group of the commonly connected X electrodes XX3 consists of electrodes X3, X3+j, X3+2j, . . . , X3+(q−1)j commonly connected thereto, and similarly, jth group of the commonly connected X electrodes XXj consists of electrodes Xj, X2j, X3j, . . . , Xqj commonly connected thereto.

The driving method of the first and second embodiments of the electrode connections as described above is performed in the following sequence.

Figure 1A:
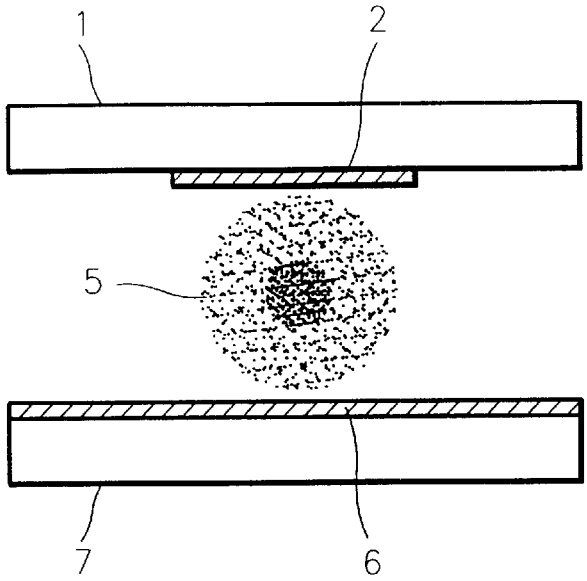
FIG. 1*a* is a vertical section view illustrating a basic structure of a general DC type facing discharge plasma display panel.
Figure 1B:
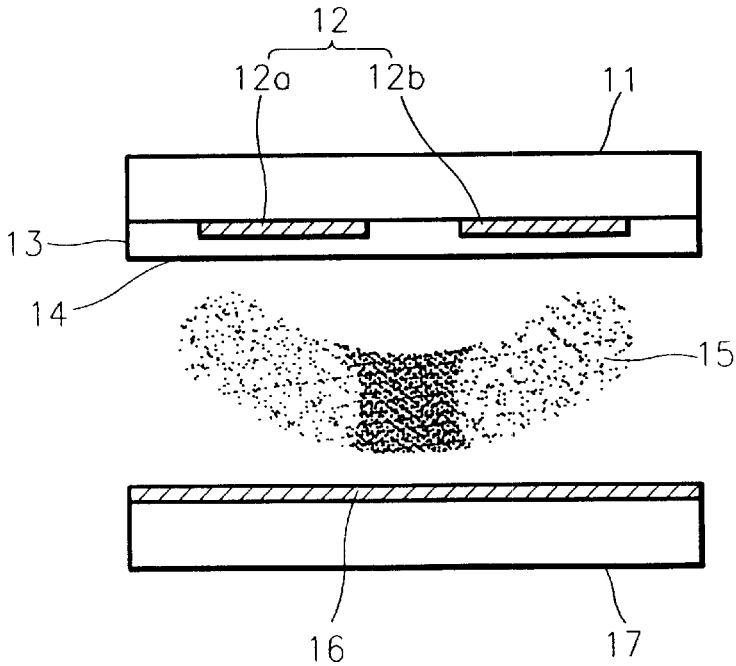
FIG. 1*b* is a vertical section view illustrating a basic structure of a general AC type surface discharge plasma display panel.
Figure 2A:
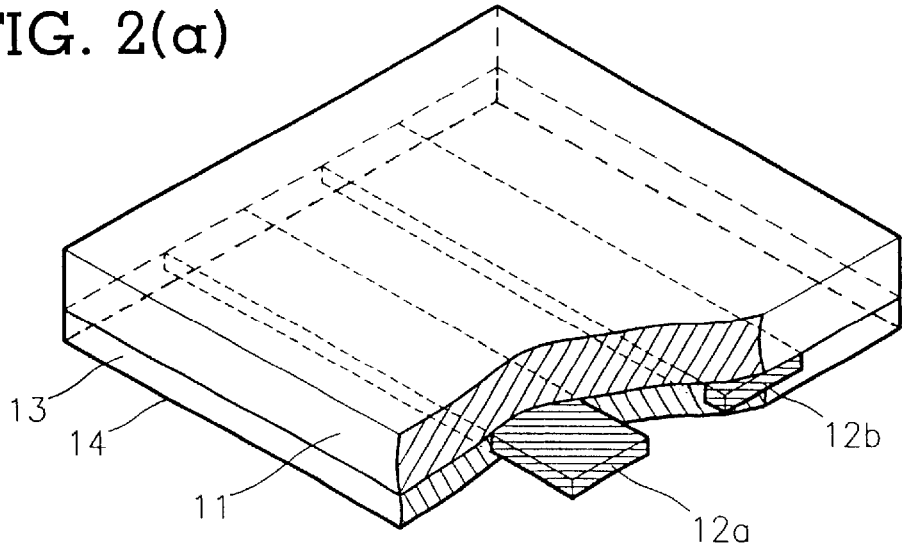
FIG. 2 is a schematic exploded perspective view of the AC type surface discharge plasma display panel shown in FIG. 1*b;*
Figure 2B:
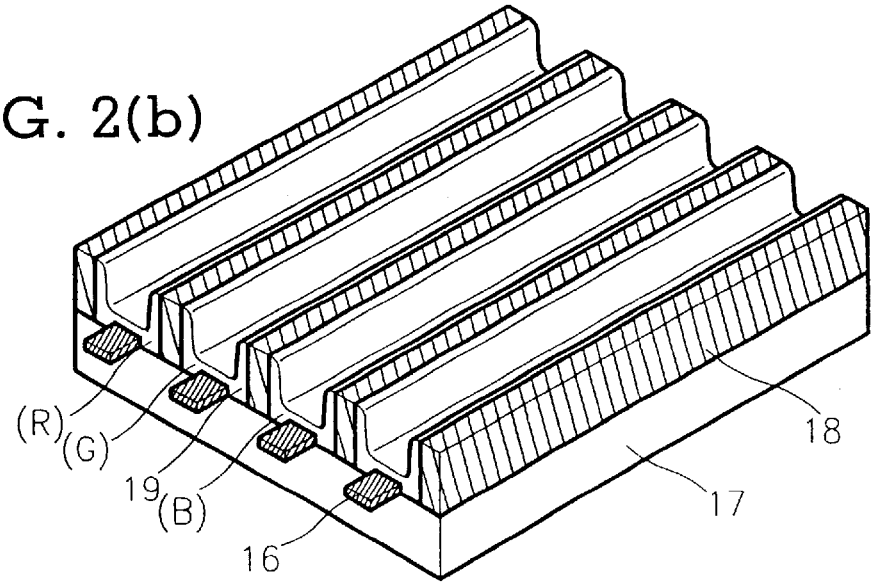
Figure 3:
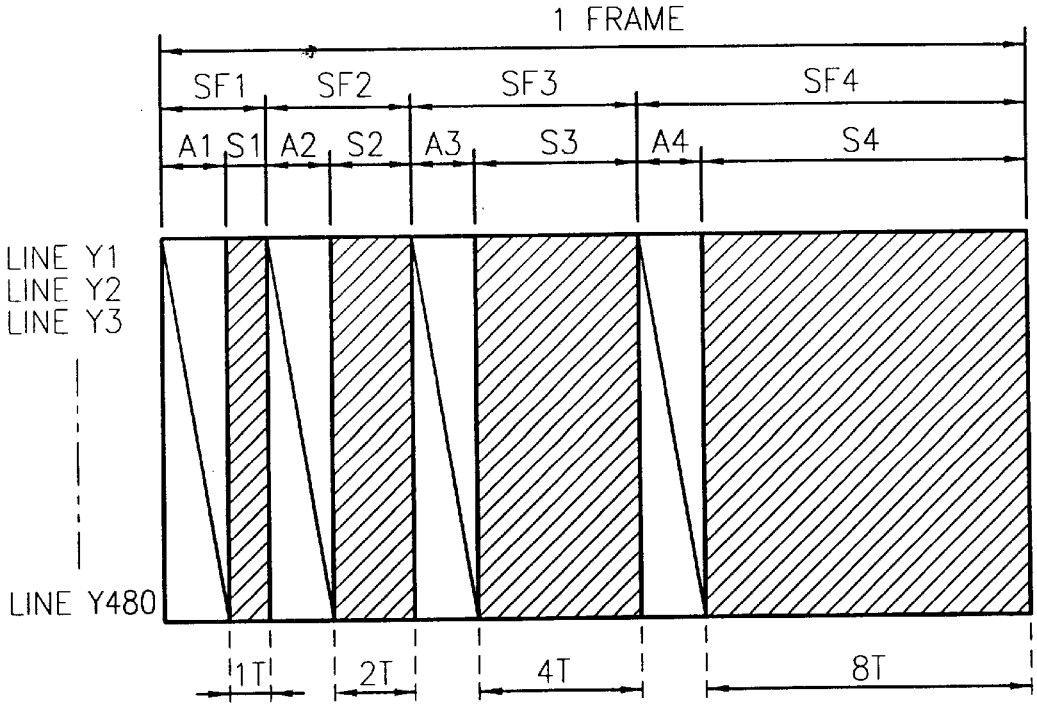
FIG. 3 is an explanatory diagram to explain a gray scale exhibition method of the AC type plasma display panel shown in FIG. 2.
Figure 4:
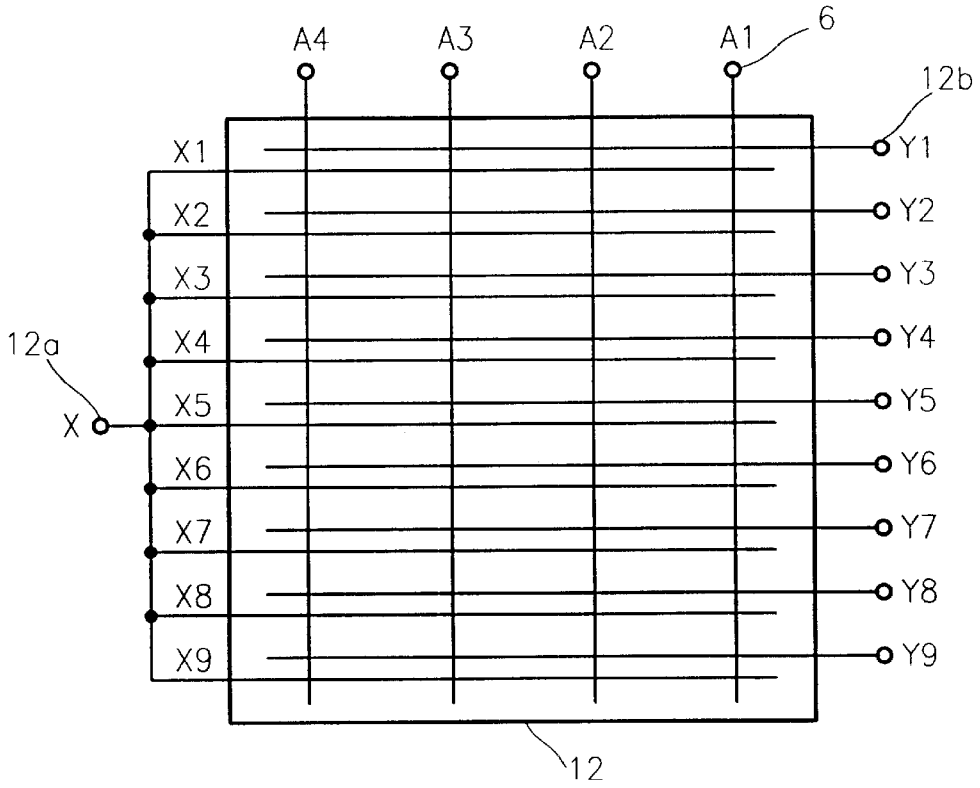
FIG. 4 (PRIOR ART)
FIG. 4 is a diagram illustrating an electrode connection scheme of the AC type surface discharge plasma display panel shown in FIG. 2 to realize the gray scale exhibition method of FIG. 3.
Figure 5:
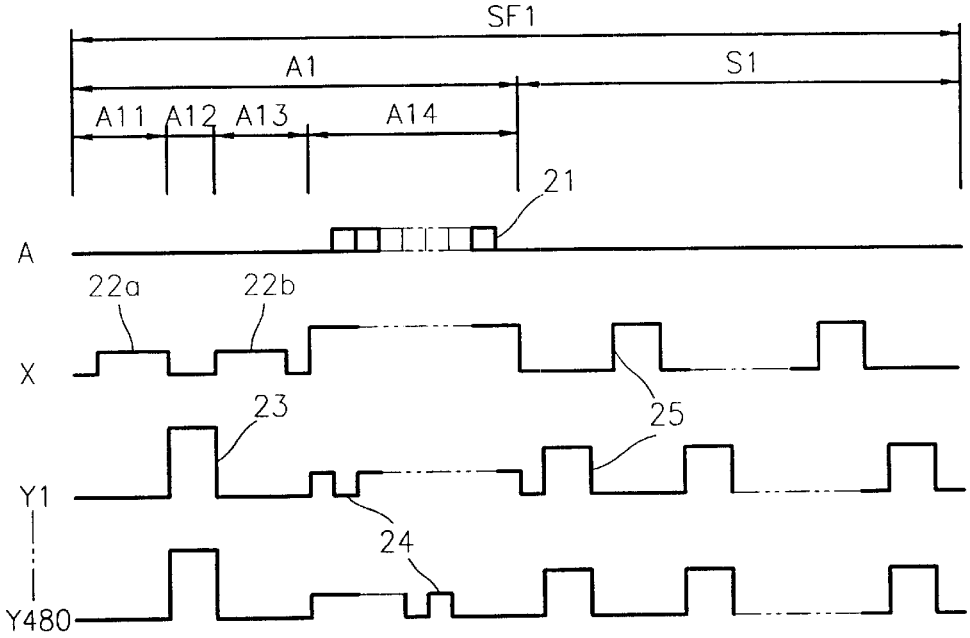
FIG. 5 (PRIOR ART)
FIG. 5 is a diagram illustrating the waveforms of driving signals respectively impressed to the electrodes shown in FIG. 4.
Figure 6A:
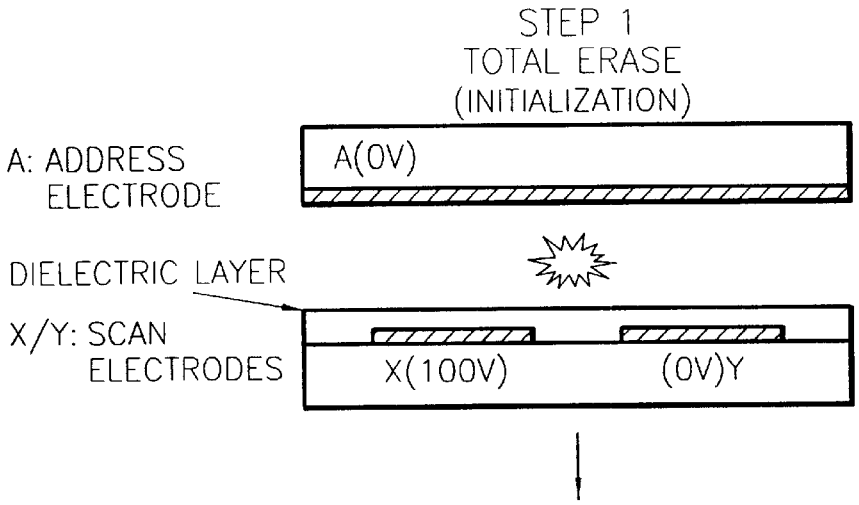
FIG. 6a (PRIOR ART)
FIGS. 6*a* through 6*f* are explanatory diagrams illustrating charge distributions created in a discharge space of the AC type surface discharge plasma display panel when the electrodes shown in FIG. 4 are driven by the driving signals shown in FIG. 5.
Figure 6B:
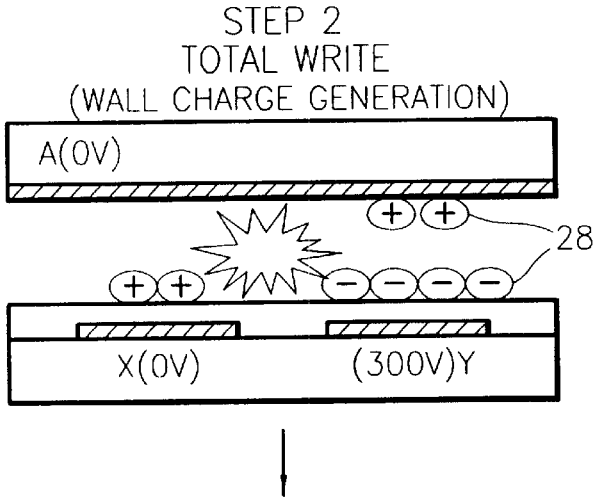
FIG. 6b (PRIOR ART)
Figure 6C:
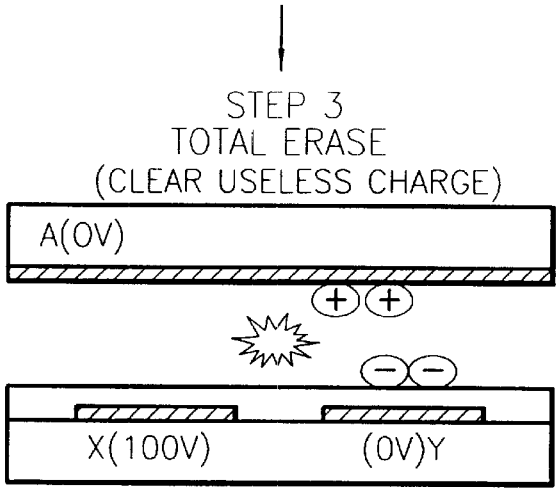
FIG. 6c (PRIOR ART)
Figure 6D:
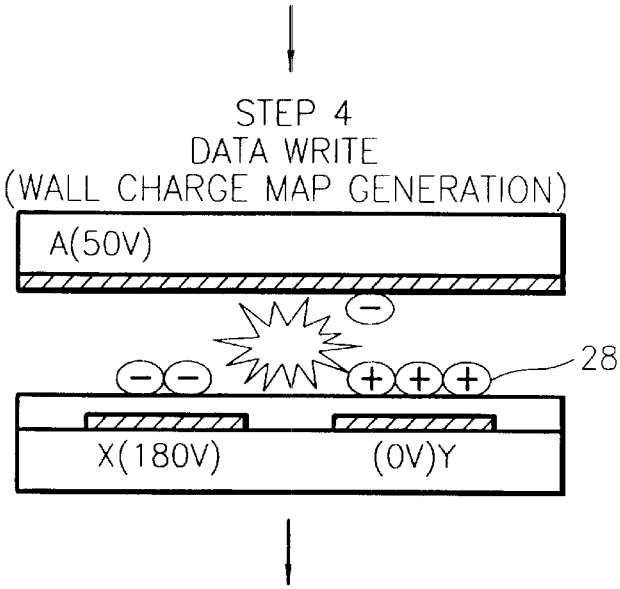
FIG. 6d (PRIOR ART)
Figure 6E:
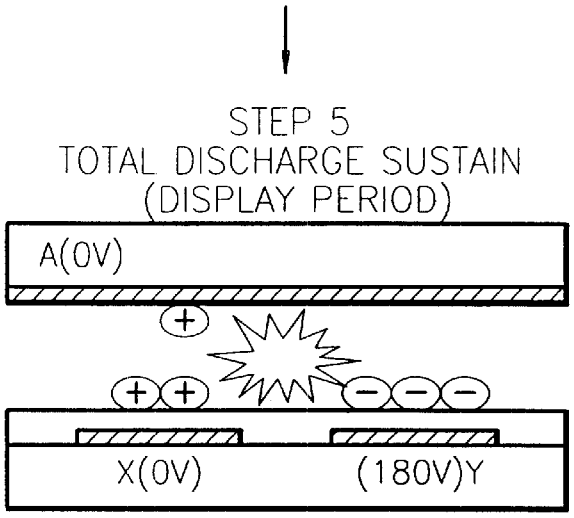
FIG. 6e (PRIOR ART)
Figure 6F:
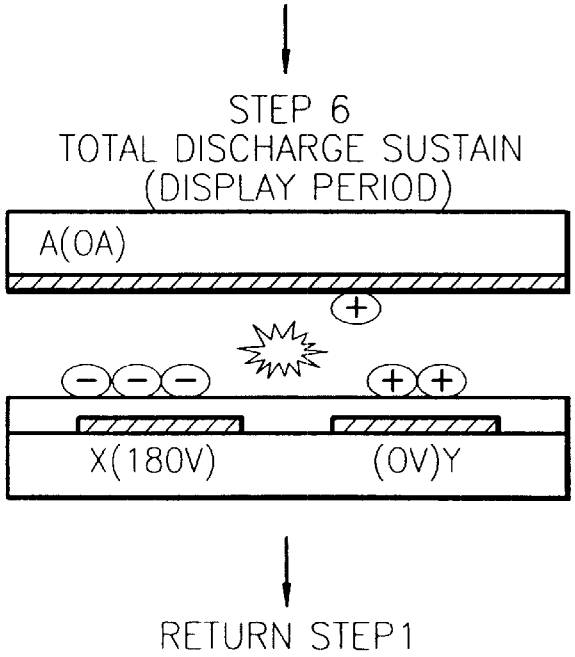
FIG. 6f (PRIOR ART)

At first, as an initialization step, the wall charge created at the subfield in the previous step is completely erased by the impression of total erase pulses 22*a* and 22*b*, a total write pulse 23, or the like during a total erase period A11, a total write period A12, or a total erase period A13 as shown in FIG. 5.

Figure 8:
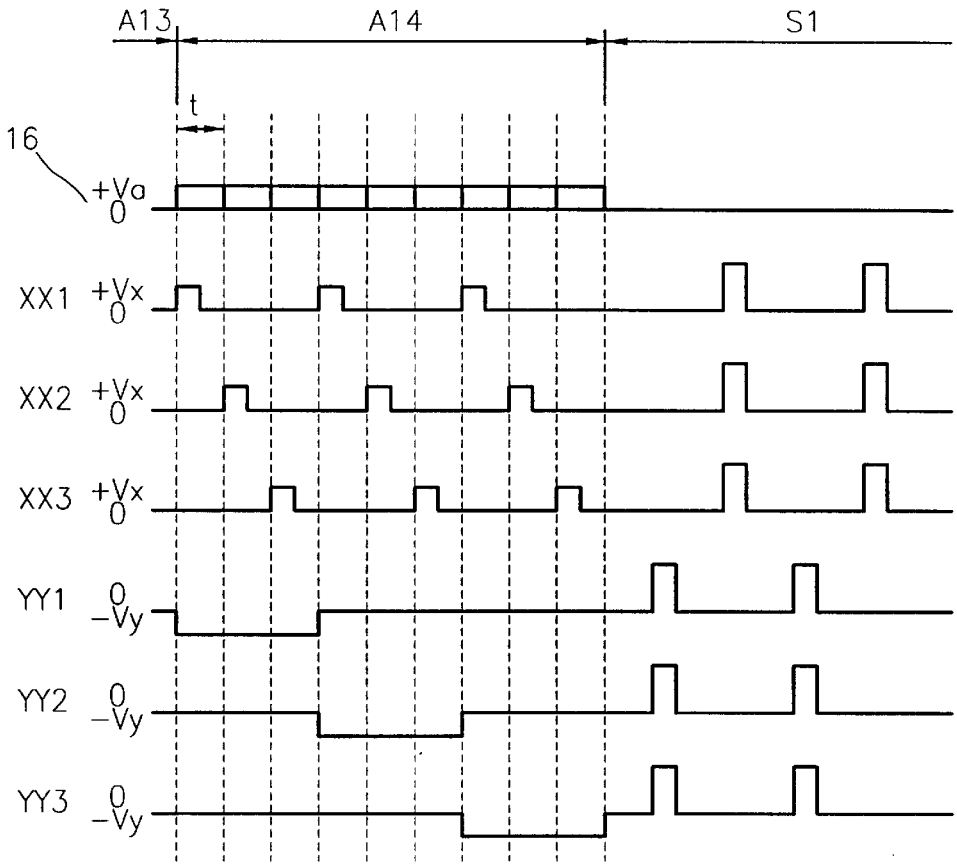
FIG. 8 is a diagram illustrating the waveforms of driving signals respectively impressed to the electrodes of the AC type plasma display panel, connected as shown in FIG. 7.

Next, an addressing step is carried out by impressing electrode driving signals respectively to the electrodes as shown in FIG. 8 in the following orders (A driving method with respect to the first embodiment).

Figure 10A:
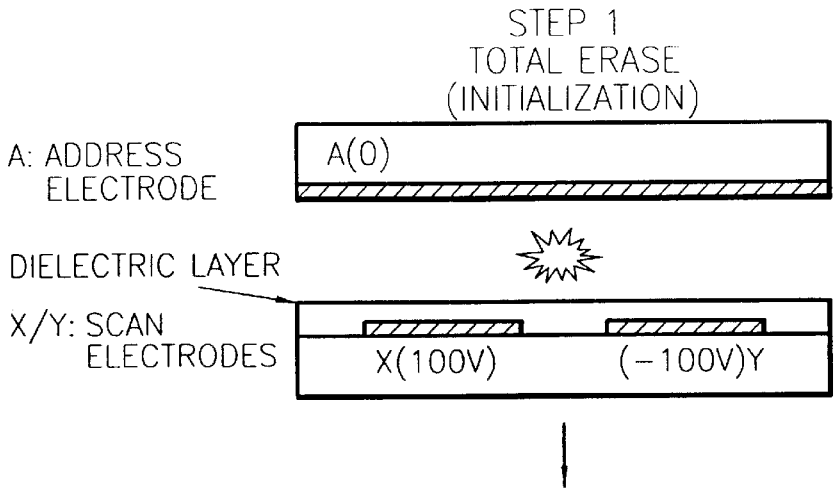
FIGS. 10*a* through 10*e* are explanatory diagrams illustrating charge distributions created in a discharge space of the AC type plasma display panel of FIG. 7 when the driving signals shown in FIG. 8 are impressed.
Figure 10B:
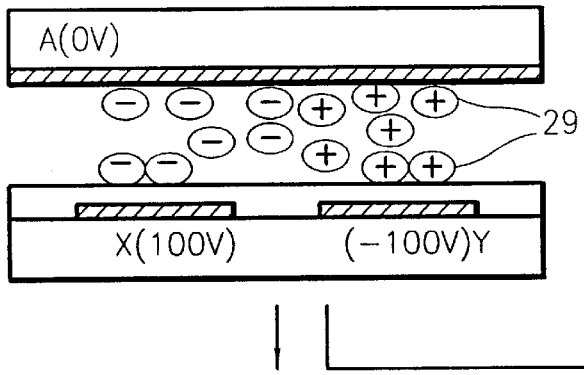

1. As shown in FIG. 7, $+V_x$ is impressed to the group of the commonly connected X electrodes, XX1, $-V_y$ is impressed to the group of the commonly connected Y electrodes, YY1, and the other groups of the commonly connected electrodes are in a 0 V state. At this time, if a voltage $V_x+V_y$ across two groups of the commonly connected electrodes XX1 and YY1 is set to be higher than a discharge start voltage $V_{bd}$, the impressing voltages $V_x$ and $V_y$ are set to be lower than $V_{bd}$, a discharge occurs only between electrodes X1 and Y1 as shown in FIG. 10*a*, and a space charge 29 is created as shown in FIG. 10*b*. The space discharge 29 is utilized to prime an address discharge. When a voltage impressed to an address electrode 16 is $V_a$, a voltage drop in the discharge start voltage by the priming is $V_p$, and a voltage $V_a+V_x$ (or $Y_y$) impressed across the address electrode and the scan electrodes is set to be lower than the discharge start voltage $V_{bd}$ and higher than the diminished discharge start voltage $V_{bd}-V_p$ dropped by the priming, the address discharge can occur. Here, for the address discharge, $V_x$ or $V_y$ is properly selected as a driving signal of the scan electrodes according to the polarity of the voltage impressed to the address electrode.

Further, the amplitude of the voltage impressed to the address electrode $V_a$ is selected in the range to not cause a discharge with the already scanned scan electrodes. The address discharge occurs, as shown in FIG. 10*d*, only between the address electrode and the electrodes X1 and Y1 at this moment, a wall charge $V_{wa2}$ for writing is created as shown in FIG. 10*e*.

Figure 10C:
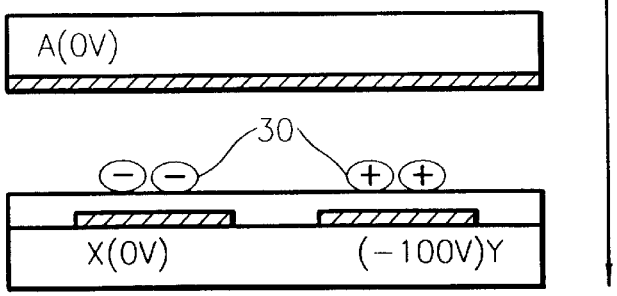
Figure 10D:
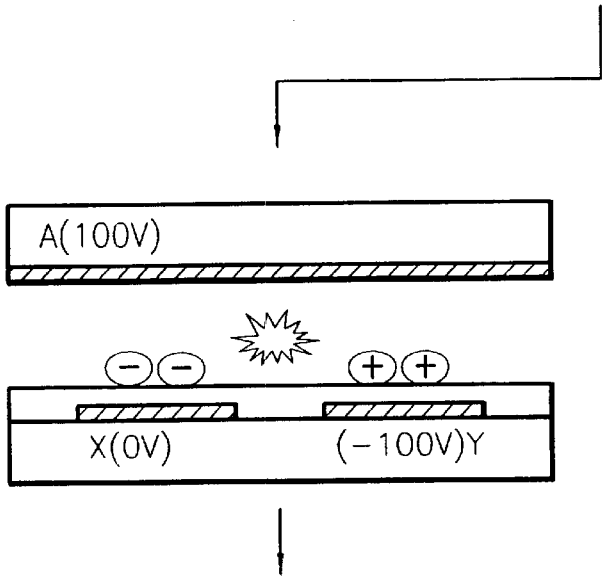
Figure 10E:
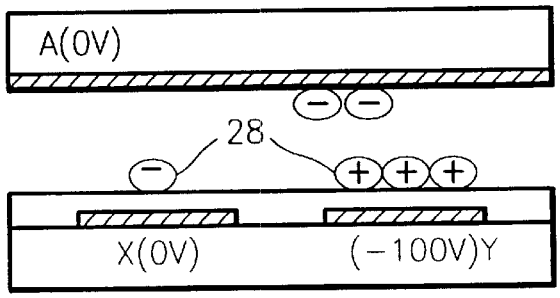

On the other hand, when the address discharge does not occurs, a wall charge of 30 $V_{w0}$ is created, as shown in FIG. 10*c*, by the discharge between the electrodes X1 and Y1. Since the wall charge $V_{wa}$ 28 created by the address discharge is greater than the wall charge $V_{w0}$ created without the address discharge, the addressing function can be performed.

2. Next, $+V_x$ is impressed to the group of the commonly connected X electrodes, XX2, $-V_y$ is impressed to the group of the commonly connected Y electrodes, YY1, and the other groups of the commonly connected electrodes are in a 0 V state. In this case, a priming discharge occurs between the electrodes X2 and Y2, an address discharge occurs only between an address electrode and the electrodes X2 and Y2, and thereby a wall charge 28 for writing is created.

3. Next, $+V_x$ is impressed to the group of the commonly connected X s electrodes, XX3, $-V_y$ is impressed to the group of the commonly connected Y electrodes, YY1, and the other groups of the commonly connected electrodes are in a 0 V state. In this case, a priming discharge occurs between the electrodes X3 and Y3, an address discharge occurs only between an address electrode and the electrodes X3 and Y3, and thereby a wall charge 28 for writing is created.

4. Next, $+V_x$ is impressed to the group of the commonly connected X electrodes, XX2, $-V_y$ is impressed to the group of the commonly connected Y electrodes, YY2, and the other groups of the commonly connected electrodes are in a 0 V state. In this case, a priming discharge occurs between the electrodes X4 and Y4, an address discharge occurs only between an address electrode and the electrodes X4 and Y4, and thereby a wall charge 28 for writing is created.

5. Next, $+V_x$ is impressed to the group of the commonly connected X electrodes, XX2, $-V_y$ is impressed to the group of the commonly connected Y electrodes, YY2, and the other groups of the commonly connected electrodes are in a 0 V state. In this case, a priming discharge occurs between the electrodes X5 and Y5, an address discharge occurs only between an address electrode and the electrodes X5 and Y5, and thereby a wall charge 28 for writing is created.

6. Next, $+V_x$ is impressed to the group of the commonly connected X electrodes, XX3, $-V_y$ is impressed to the group of the commonly connected Y electrodes, YY2, and the other groups of the commonly connected electrodes are in a 0 V state. In this case, a priming discharge occurs between the electrodes X6 and Y6, an address discharge occurs only between an address electrode and the electrodes X6 and Y6, and thereby a wall charge 28 for writing is created.

7. Next, $+V_x$ is impressed to the group of the commonly connected X electrodes, XX1, $-V_y$ is impressed to the group of the commonly connected Y electrodes, YY3, and the other groups of the commonly connected electrodes are in a 0 V state. In this case, a priming discharge occurs between the electrodes X7 and Y7, an address discharge occurs only between an address electrode and the electrodes X7 and Y7, and thereby a wall charge 28 for writing is created.

8. Next, $+V_x$ is impressed to the group of the commonly connected X electrodes, XX2, $-V_y$ is impressed to the group of the commonly connected Y electrodes, YY3, and the other groups of the commonly connected electrodes are in a 0 V state. In this case, a priming discharge occurs between the electrodes X8 and Y8, an address discharge occurs only between an address electrode and the electrodes X8 and Y8, and thereby a wall charge 28 for writing is created.

9. Next, $+V_x$ is impressed to the group of the commonly connected X electrodes, XX3, $-V_y$ is impressed to the group of the commonly connected Y electrodes, YY3, and the other groups of the commonly connected electrodes are in a 0 V state. In this case, a priming discharge occurs between the electrodes X9 and Y9, an address discharge occurs only between an address electrode and the electrodes X9 and Y9, and thereby a wall charge 28 for writing is created.

Now, an address period has finished, and then a sustaining period of a display discharge begins and a display discharge voltage is impressed to all the X and Y electrodes, and, in this case, if $V_s$ impressed across the scan electrodes for the display discharge satisfies the relation of $V_s+V_{wa}>V_s>V_s+V_{w0}$, the display discharge begin to occur.

After the sustaining period of the display discharge has finished, the initialization step of next subfield begins by returning to the first step.

In driving the first embodiment of the plasma display panel as described above, the pulse width of driving signal pulses (a voltage of $V_x$) impressed to the groups of commonly connected X electrodes XX1, XX2, and XX3 among driving voltage waveforms of the address period A14 and the sustaining period of the display discharge S1 in the driving signals of FIG. 8 impressed to the address electrode 16, the groups of commonly connected X electrodes XX1, XX2, and XX3, and the groups of commonly connected X electrodes YY1, YY2, and YY3 of the first embodiment, is corresponding to the half of the pulse width t of the driving signal (a voltage of $V_a$) impressed to the address electrode 16 to stabilize the address discharge. In other words the driving signal of the X electrodes is generated to have a pulse width corresponding to the half of the pulse width of the address discharge pulses.

Figure 11:
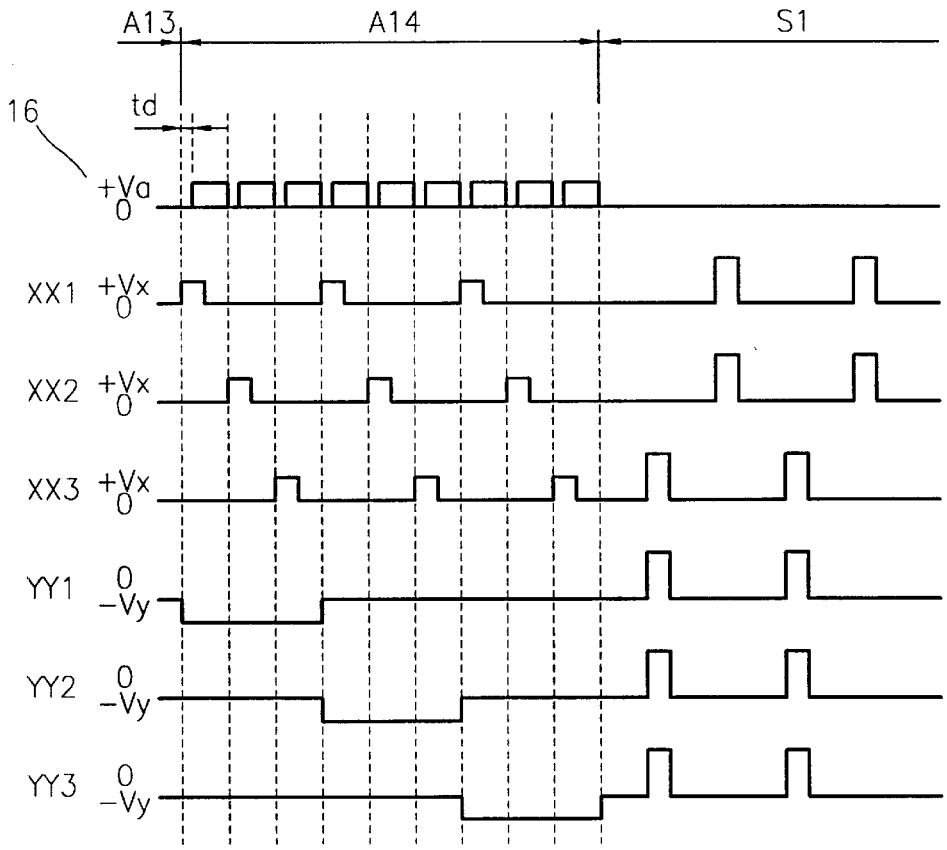
FIG. 11 is a diagram illustrating the waveforms of another driving signals respectively impressed to the electrodes of the AC type plasma display panel, connected as shown in FIG. 7.

On the other hand, FIG. 11 shows , as another example of a method to impress the driving signals to the electrodes of the first embodiment, a method to impress the driving signal pulses of the address electrode to the address electrode 16 at a given time $t_d$ after the driving signal pulses of the X and Y electrodes are impressed to the X and Y electrodes to prevent cross talks from occurring, which take place because the priming discharge and the address discharge occur concurrently in the address period A14. In this method, because the scan discharge between X and Y electrodes occurs and the address discharge occurs by utilizing the space charge created in the scan discharge, the wall charge states created at the X and Y electrodes can be always reproduced.

Figure 12:
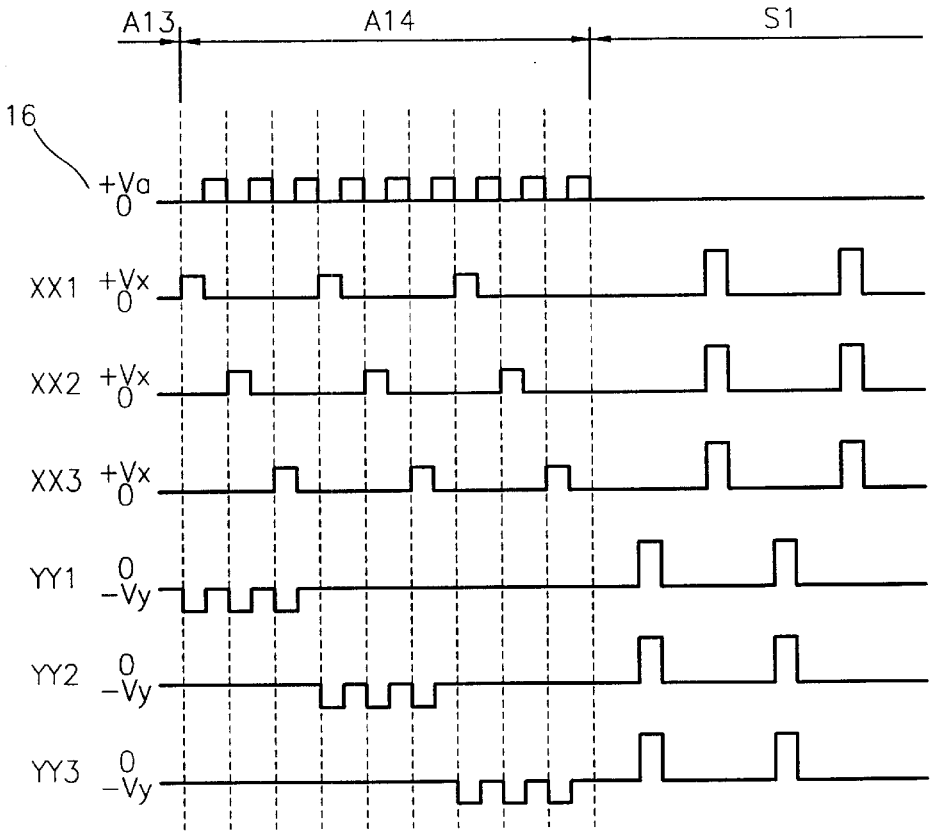
FIG. 12 is a diagram illustrating the waveforms of still another driving signals respectively impressed to the electrodes of the AC type plasma display panel, connected as shown in FIG. 7.
Figure 13:
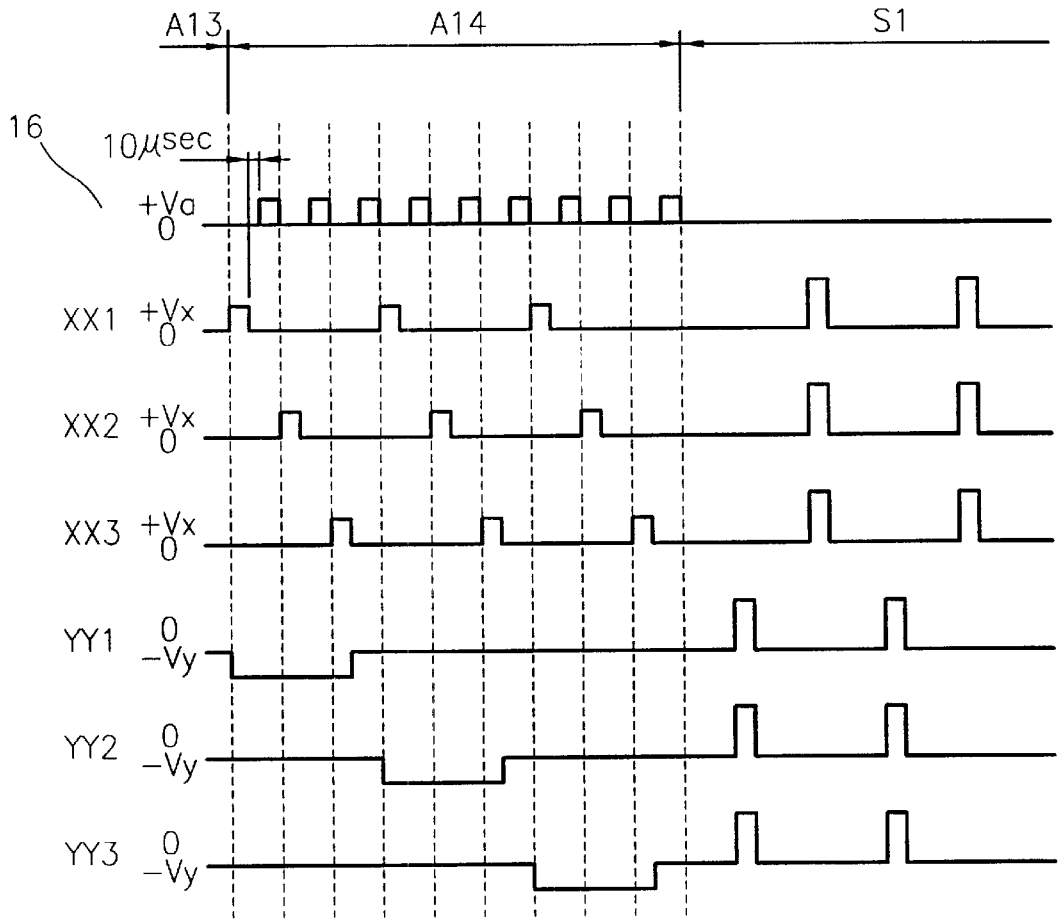
FIG. 13 is a diagram illustrating the waveforms of still another driving signals respectively impressed to the electrodes of the AC type plasma display panel, connected as shown in FIG. 7.
Figure 14A:
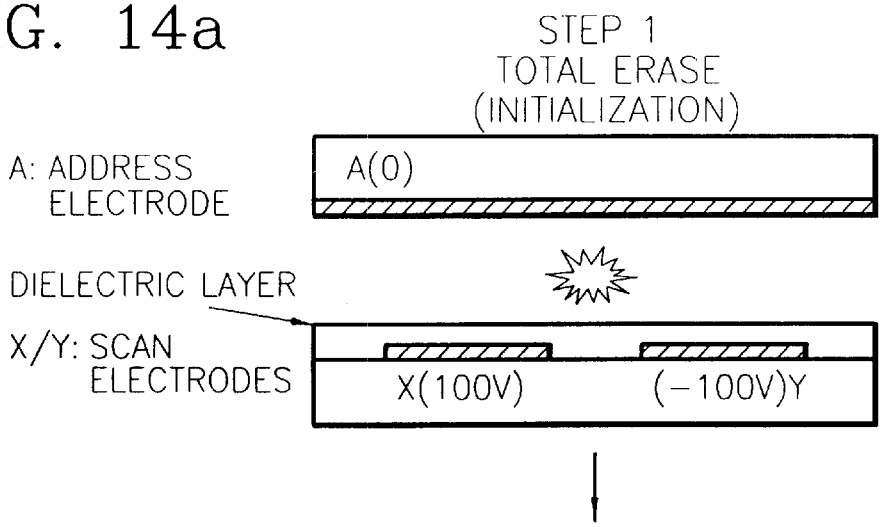
FIGS. 14*a* through 14*e* are explanatory diagrams illustrating charge distributions created in a discharge space of the AC type plasma display panel of FIG. 7 when the driving signals shown in FIG. 12 are impressed.
Figure 14B:
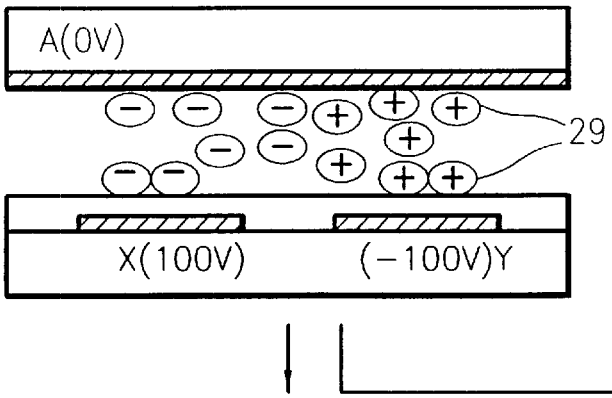
Figure 14C:
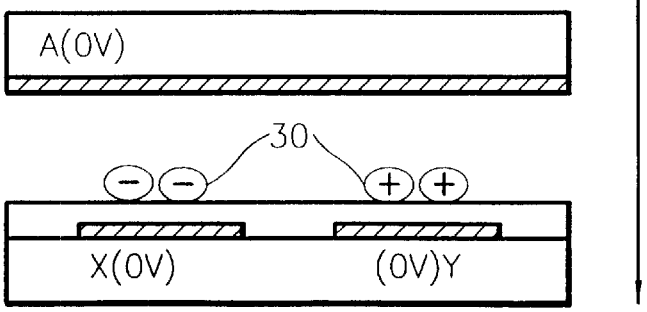
Figure 14D:
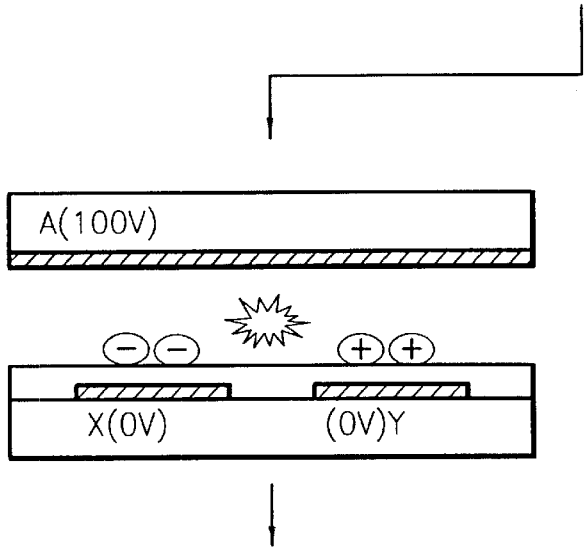
Figure 14E:
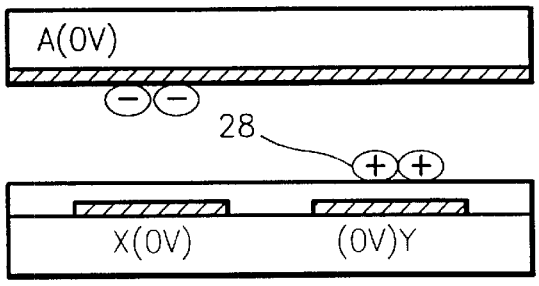

In addition, FIG. 12 shows still another example of a method to impress the driving signals to the electrodes of the first embodiment. Voltages $V_x$ and $-V_y$ of driving pulse signals are synchronously impressed respectively to the groups of commonly connected X electrodes XX1, XX2, and XX3, and the corresponding groups of commonly connected X electrodes YY1, YY2, and YY3, and then immediately each driving signal pulse (a voltage of $V_a$) of the address electrode is impressed to the address electrode 16. In this case, as a case inverse to the example of FIG. 11, the wall charge 30 created by the scan discharge of X and Y electrodes is erased by the address discharge to be the state as shown in FIG. 14*e*. Namely, the pixel selected by the address discharge exhibit inverse operation to be off state by decrease of the wall charge 28. In this case, unstable operation expected in normal operation because of becoming narrow in the range of operating voltage can be improved. As described above, in the case that each driving signal pulse $V_a$ of the address electrode is impressed to the address electrode 16 immediately after each driving signal pulse $V_x$ is impressed sequentially to the groups of commonly connected X electrodes XX1, XX2, and XX3, as shown in FIG. 13, $V_a$ must be impressed within at least 10 μsec after $V_x$ is impressed. FIGS. 14*a* through 14*e* are different from FIGS. 10*a* through 10*e* in the fact that a wall charge is controlled by data electrode driving pulses $+V_a$ as shown in FIG. 14*e*.

In addition, it is preferable that during the address discharge period a barrier voltage which has the same polarity of the first pulses and is lower than the second voltage with reference to the first voltage 0 V is impressed between the first pulses. Further, it is also preferable that a sustaining discharge stabilizing pulse of a fourth voltage having a width narrower than that of a sustaining discharge pulse is periodically impressed to the data electrodes during the sustaining discharge period. With respect to the barrier voltage and the sustaining discharge stabilizing pulse, the explanation described later concerning FIG. 25 and an eighth embodiment may be referred.

Next, third and fourth embodiments and fifth, sixth and seventh embodiments of a plasma display panel according to the present invention is described. These embodiments have a common feature that a plasma display panel consists of a plurality of blocks or display units. That is to say, when k is an integer, a m×n matrix plasma display panel is expressed by a km'×n matrix having km'×n matrix display units arranged, and each of the k display units having the same electrode connection schemes has i' sustaining electrode groups in each group of which one (fifth, sixth and seventh embodiments) or p' (third and fourth embodiments) neighboring sustaining electrodes are connected to each other. When, in the k display units, a first display unit is expressed by subgroups of commonly connected Y'(1) electrodes, YY'1(1), YY'2(1), . . . , YY'i'(1), a second display unit is expressed by subgroups of commonly connected Y'(1) electrodes, YY'1(2), YY'2(2), . . . , YY'i'(2), and similarly, a kth display unit is expressed by subgroups of commonly connected Y'(k) electrodes, YY'1(k), YY'2(k), . . . , YY'i'(k), the groups of commonly connected Y electrodes, YY1, YY2, . . . , YYi of the m×n matrix, each are expressed by respective subgroups. Among the subgroups of the k display unit, a first group YY1 consists of subgroups YY'1(1), YY'1(2), . . . , YY'1(k) commonly connected thereto, among the subgroups of the k display unit, a second group YY2 consists of subgroups YY'2(1), YY'2(2), . . . , YY'2(k) commonly connected thereto, and similarly, among the subgroups of the k display unit, a Ah group YYi consists of subgroups YY'k(1), YY'k(2), . . . , YY'k(k) commonly connected thereto.

Figure 15:
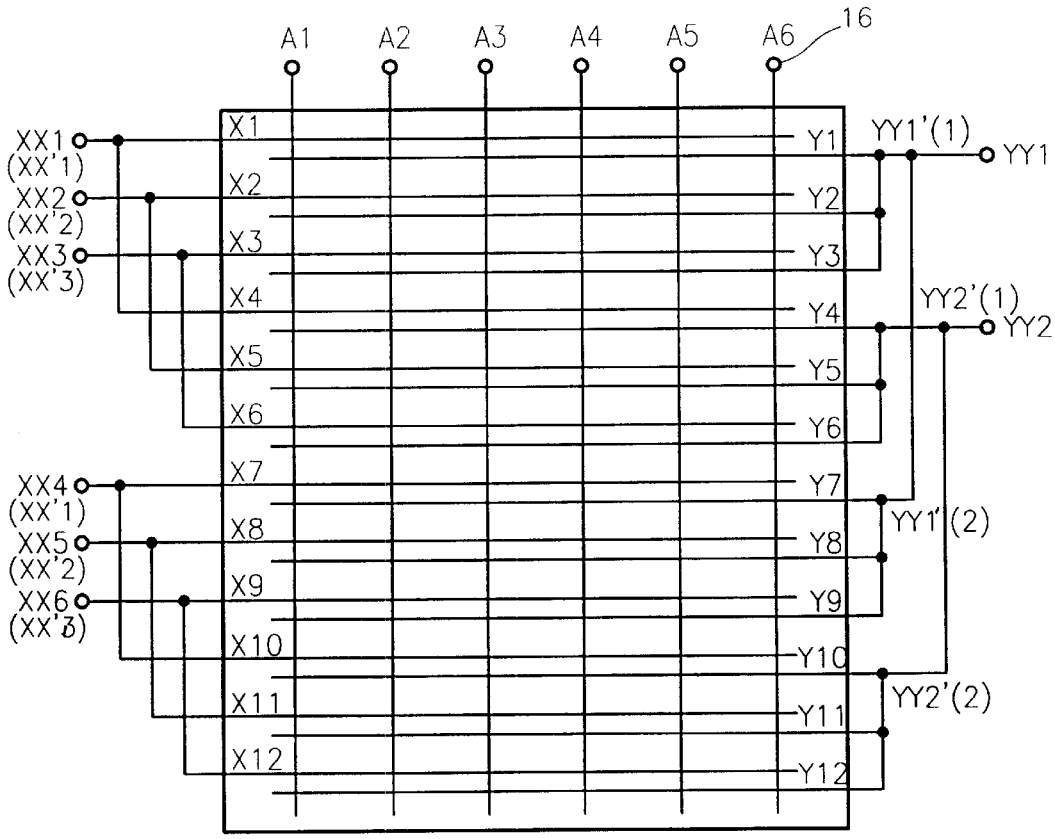
FIG. 15 is a diagram illustrating a third embodiment of an electrode connection scheme of an AC type plasma display panel according to the present invention.

FIG. 15 shows an electrode connection scheme of the third embodiment. The electrode connection scheme of the third embodiment is an extended electrode connection scheme of the first embodiment. Namely, as described above the groups of commonly connected electrodes are divided into a plurality of blocks, and groups of commonly connected Y electrodes and groups of commonly connected X electrodes of each block are connected to operate as the first embodiment of the second embodiment and to form display units. Then, groups of commonly connected electrodes of the display units are appropriately connected. As shown in FIG. 15, among scan electrodes of the plasma display panel, X electrodes are divided into a group of commonly connected X electrodes XX1, XX2 and XX3, and another group of commonly connected X electrodes XX4, XX5 and XX6 which have an identical connection scheme, and Y electrodes are divided into subgroups of commonly connected neighbor Y electrodes, YY1(1)(Y1, Y2, Y3), YY2'(1)(Y4, Y5, Y6), YY1'(2)(Y7, Y8, Y9), and YY2'(2)(Y10, Y11, Y12), and the subgroups are divided into groups of commonly connected subgroups, YY1(Y1'(1)+YY1'(2)), and YY2(YY2'(1)+YY2'(2)). In the panel having an electrode connection scheme like this, the panel can be divided into two portions and scanned separately. In such a manner, if the electrode connection scheme of groups of commonly connected subgroups, YY1 and YY2 is changed as required, the panel can be divided into multiple portions and scanned separately. In other words, the third embodiment has the electrode connection scheme such as a multitude of electrode connection arrays of the first embodiment or the second embodiments are arranged and the groups of commonly connected Y electrodes as subgroups selected at a regular intervals are commonly connected.

Such the electrode connection scheme of the third embodiment is generally expressed as follows.

Figure 16:
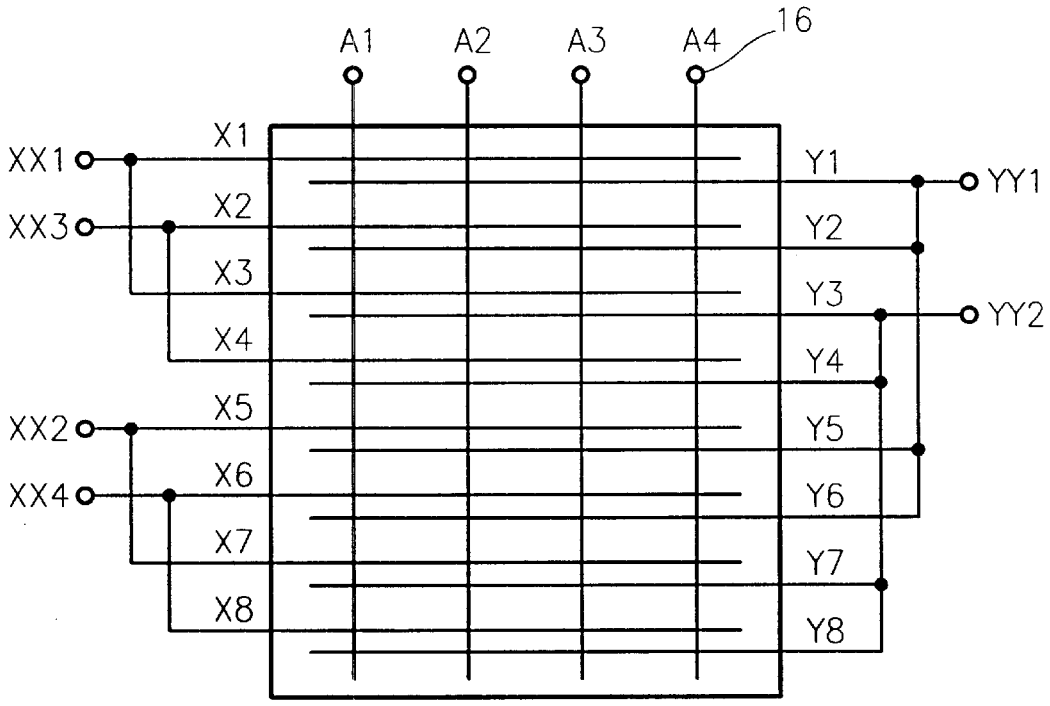
FIG. 16 is a diagram illustrating a fourth embodiment of an electrode connection scheme of an AC type plasma display panel according to the present invention.
Figure 17:
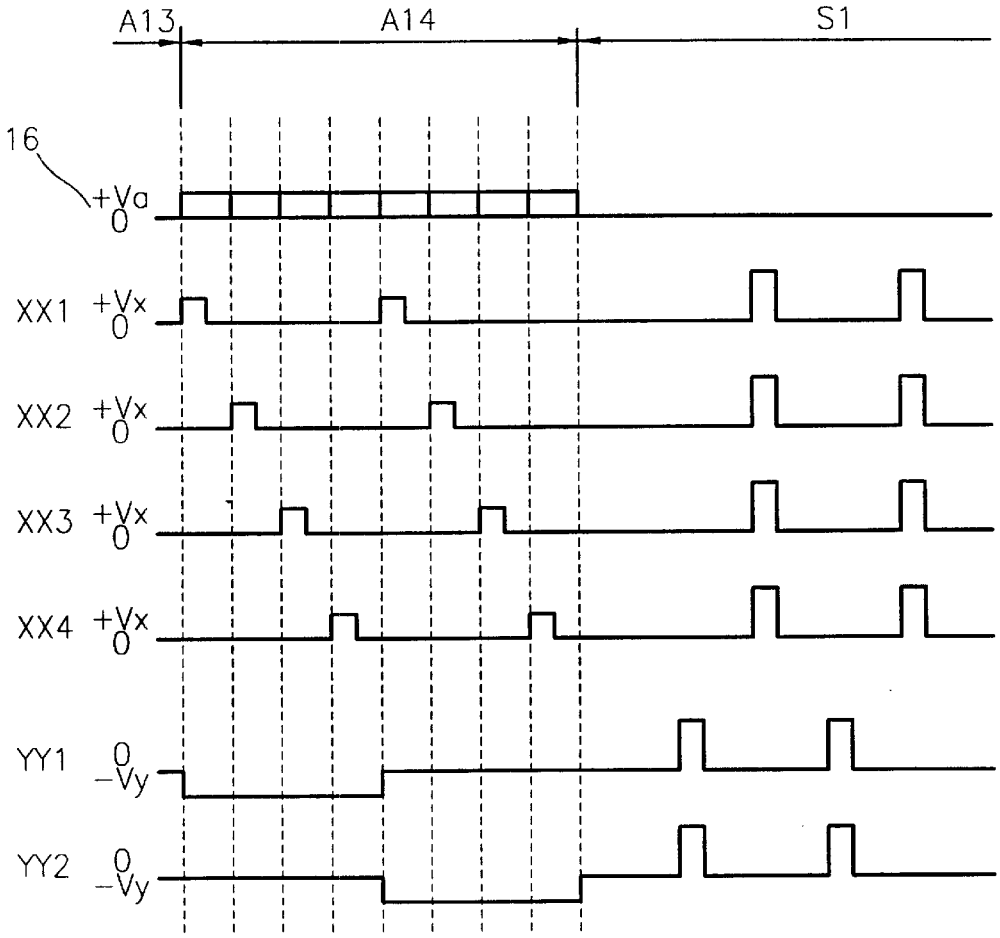
FIG. 17 is a diagram illustrating the waveforms of driving signals respectively impressed to the electrodes of the AC type plasma display panel, connected as shown in FIG. 16.

In the k display units of m'×n matrix, a first group of commonly connected Y electrodes, YY1 consists of first subgroups of blocks YY'1(1), YY'1(2), . . . , YY'1(k), i.e., (Y1,.Y2, . . . , Yp')(1) (Y1, Y2, . . . , Yp')(k) commonly connected thereto, a second group of commonly connected Y electrodes, YY2 consists of second subgroups of blocks YY'2(1), YY'2(2), . . . , YY'2(k), i.e., (Yp'+1, Yp'+2, Yp'+3, . . . , Y2p)(1) (Yp'+1, Yp'+2, Yp'+3, . . . , Y2p)(k) commonly connected thereto, a third group of commonly connected Y electrodes, YY3 consists of third subgroups of blocks YY'3 (1), YY'(2), . . . , YY'3(k), i.e., (Y2p'+1, Y2p'+2, Y2p'+3, . . . , Y3p') (1)~(Y2p'+1, Y2p'+2, Y2p'+3, . . . , Y3p')(k) commonly connected thereto, and similarly, a ith group of commonly connected Y electrodes, YYi consists of i'th subgroups of blocks YY'i'(1), YY'i'(2), . . . , YY'i'(k), i.e., (Y(i'−1)p'+1, Y(i')p'+2, Y(i')p'+3, . . . , Yi'p)(1) (Y(i'−1)p'+1, Y(i'−1)p'+2, Y(i'−1)p'+3, . . . , Yi'p')(k) commonly connected thereto. When the number of common electrodes respectively connected to the groups of the commonly connected X' electrodes, XX'1, XX'2, . . . , XX'j of the k display units of m'×n matrix is q', the first group of the commonly connected X' electrodes, XX'1 consists of electrodes X1, X1+j', X1+2j', . . . , X1+(q'−1)j' commonly connected thereto, the second group of the commonly. connected X' electrodes, XX'2 consists of electrodes X2, X2+j', X2+2j', . . . , X2+(q'−1)j' commonly connected thereto, the third group of the commonly connected X' electrodes, XX'3 consists of electrodes X3, X3+j', X3+2j', . . . , X3+(q'−1)j' commonly connected thereto, and similarly, jth group of the commonly connected X' electrodes, XX'j' consists of electrodes Xj', X2j', X3j', . . . , Xq'j' commonly connected thereto, and thus the common electrodes are grouped so that the groups of the commonly connected X' electrodes in same order of each display unit may be sequentially driven. The third embodiment shown in FIG. 15 is the case of k=2, i.e., an example of a 12×6 matrix plasma display panel having two 4×4 matrix electrode arrays arranged. Here, the first group YY1 consists of subgroups YY1'(1) and YY1'(2) commonly connected thereto, and the second group YY2 consists subgroups YY2'(1) and YY2'(2) commonly connected thereto. The fourth embodiment shown in FIG. 16 is the case of k=2 as in the third embodiment, i.e., an example of a 8×4 matrix plasma display panel having two 4×4 matrix electrode arrays arranged. The fourth embodiment, as a modification of the third embodiment, has an electrode connection scheme where the scanning operation is performed in a different order. In the fourth embodiment, the scanning is preformed in the order of X1, X5, X2, X6, X3, X7, X4, and X8, or Y1, Y5, Y2, Y6, Y3, Y7, Y4, and Y8, while, in the prior art, in the order of X1, X2, X3, X4, X5, X6, X7, and X5, or Y1, Y2, Y3, Y4, Y5, Y6, Y7, and Y5, and therefore the panel can be divided into two blocks, i.e., an X1 to X4 block (or an Y1 to Y4 group) and an X5 to X8 block (or an Y5 to Y8 group) and scanned separately. FIG. 17 is a diagram illustrating the waveforms of driving signals respectively impressed to the electrodes of the fourth embodiment, and the waveforms of signals have the same shape in appearance as those of FIG. 8.

Figure 18:
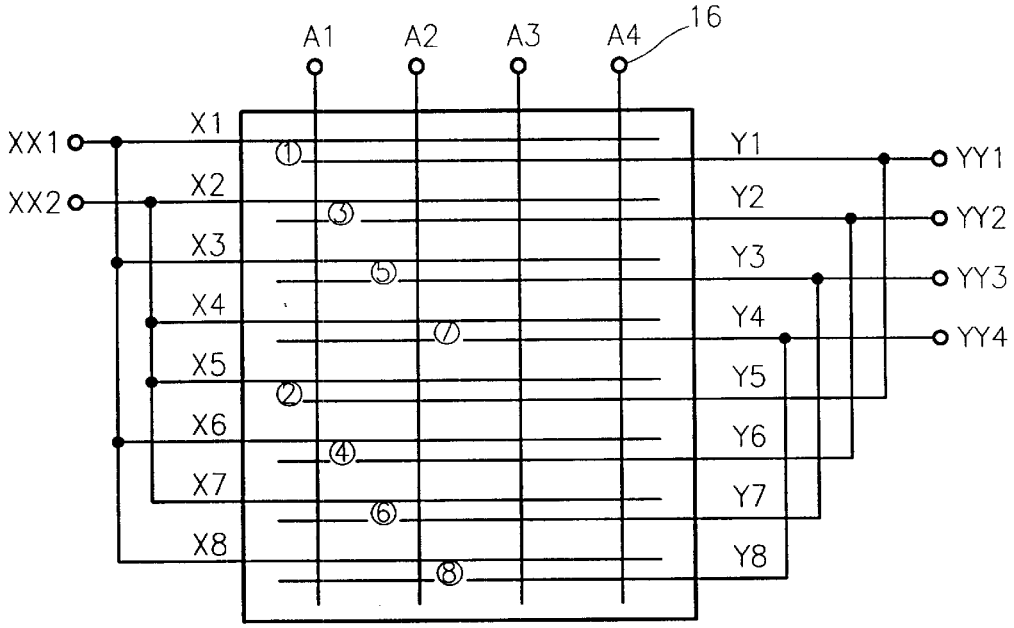
FIG. 18 is a diagram illustrating a fifth embodiment of an electrode connection scheme of an AC type plasma display panel according to the present invention.

In addition, the fifth, sixth and seventh embodiment as shown in FIG. 18 is still another embodiment having an electrode connection scheme similar to the third and fourth embodiments as described above. As shown in FIG. 18, in the fifth embodiment two blocks of common electrodes (X1, X3, X6 and X8, and X2, X4, X5 and X7) are symmetrically connected to each other, and the sustaining electrodes in the same order in each block (Y1 and Y5, Y2 and Y6, Y3 and Y7, and Y4 and Y8) are connected to each other, and therefore the scanning operation is performed in a different manner. The electrode connection scheme of the fifth embodiment is generally expressed as follows.

The fifth embodiment is, as an m×n matrix plasma display panel having m pairs of scan electrodes having m sustaining electrodes Y1, Y2, . . . , Ym and m common electrodes X1, X2, . . . , Xm which are arranged alternately and in parallel, and n data electrodes arranged to be orthogonal with respect to the m pairs of scan electrodes, a 2m'×n matrix plasma display panel in which two blocks (display units) each having m' pairs of scan electrodes having m' sustaining electrodes Y1, Y2, . . . , Ym' and m' common electrodes X1, X2, . . . , Xm' which are arranged alternately and in parallel are arranged. In other words, the fifth embodiment as a case of p=k=2 in the third and fourth embodiments has two display units, and in order to alternately drive the scan electrodes of two display units, two display units are connected as follows.

In the two display units, when the sustaining electrodes of the first display unit and the sustaining electrodes of the second display unit are respectively identified and represented by Y1, Y2, Y3, . . . , Yi' and Yi'+1, Yi'+2, Yi'+3, . . . , Y2i', while the sustaining electrodes of the 2 display unit are connected to each other to form groups of commonly connected Y electrodes YY1, YY2, YY3, . . . , YYi, respectively, the first group of the commonly connected Y electrodes, YY1 consists of electrodes Y1 and Yi'+1 commonly connected thereto, the second group of the commonly connected Y electrodes, YY2 consists of electrodes Y2 and Yi'+2 commonly connected thereto, the third group of the commonly connected Y electrodes, YY3 consists of electrodes Y3 and Yi'+3 commonly connected thereto, and similarly, the ith. group of the commonly connected Y electrodes YYi consists of electrodes Yi' and Y2i' commonly connected thereto. Here, since the relationship 2i'=2m'=m can be expressed, it is possible that the sustaining electrodes and the common electrodes of the first display unit are respectively expressed by Y1, Y2, . . . , Ym' and X1, X2, . . . , Xm' and the sustaining electrodes and the common electrodes of the second display unit are respectively expressed by Ym'+1, Ym'+2, . . . , Y2m' and Xm'+1, Xm'+2, . . . , X2m'. Therefore, it is possible in expression that a first group of commonly connected Y electrodes, YY1 consists of Y1 and Ym'+1 commonly connected thereto, a second group of the commonly connected Y electrodes, YY2 consists of electrodes Y2 and Ym'+2 commonly connected thereto, a third group of the commonly connected Y electrodes, YY3 consists of electrodes Y3 and Ym'+3 commonly connected thereto, and similarly, the ith group of the commonly connected Y electrodes YYi consists of electrodes Ym' and Y2m' commonly connected thereto. In addition, while the common electrodes of the 2 display unit are connected to each other to form groups of commonly connected X electrodes XX1, XX2, XX3, . . . , XXi, respectively, the number of the groups of commonly connected X electrodes, j, must an even number, a first group of the commonly connected X electrodes, XX1 consists of electrodes X1, X5, X2m'−4, and X2m' commonly connected thereto, a second group of the commonly connected X electrodes, XX2 consists of electrodes X2, X6, X2m'−5, and X2m'−1 commonly connected thereto, a third group of the commonly connected X electrodes, XX3 consists of electrodes X3, X7, X2m'−6, X2m'−2 commonly connected thereto, and similarly, kth group of the commonly connected X electrodes, XXj consists of electrodes Xj, Xj+4r, X2m'j+1−4r, X2m'j+1 commonly connected thereto where r is a quotient obtained by dividing j by 4. Here, considering the relationship 2m'=m, it is possible that the first group of the commonly connected X electrodes, XX1 consists of electrodes X1, X5, Xm−4, and Xm commonly connected thereto, the second group of the commonly connected X electrodes, XX2 consists of electrodes X2, X6, Xm−5, and Xm−1 commonly connected thereto, the third group of the commonly connected X electrodes, XX3 consists of electrodes X3, X7, Xm−6, Xm−2 commonly connected thereto, and similarly, jth group of the commonly connected X electrodes, XXj consists of electrodes Xj, Xj+4r, Xm−j+1−4r, Xm−j+1 commonly connected thereto where r is a quotient obtained by dividing j by 4.

Figure 20:
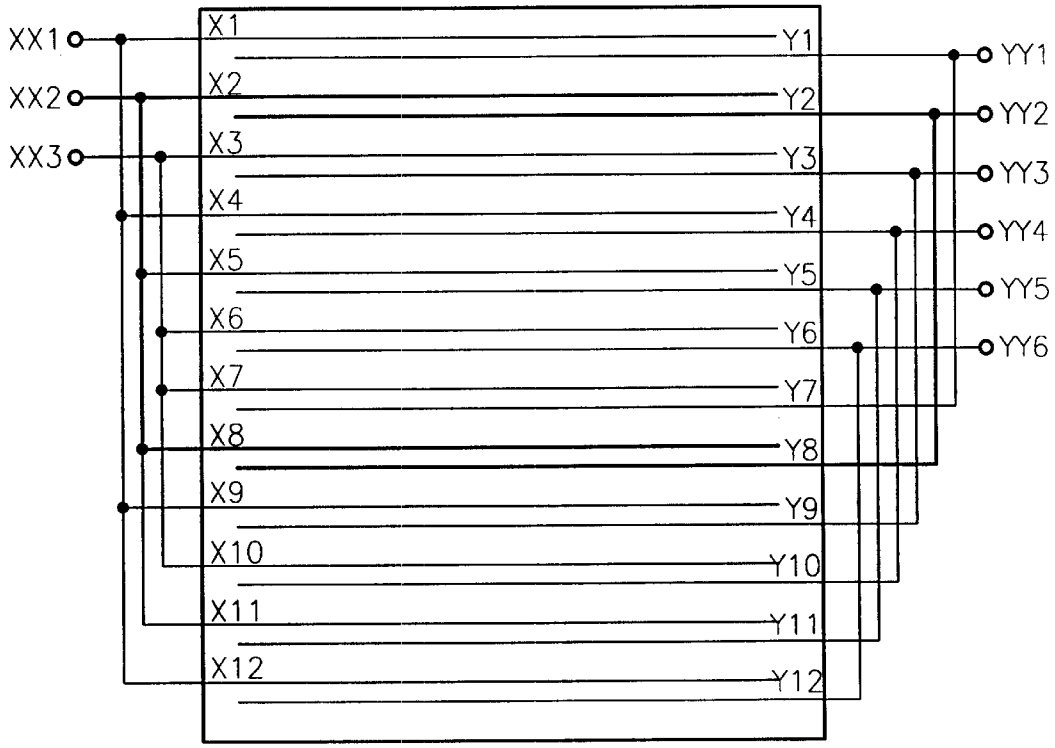
FIG. 20 is a diagram illustrating an example of a wrong electrode connection scheme of an AC type plasma display panel according to the present invention.

In the fifth embodiment, since the number of blocks of scan electrode groups, which are scanned alternately is 2, k=2, and since in groups of commonly connected Y electrodes, YY1, YY2, . . . , YYi, each group must have one sustaining electrode respectively in two blocks, the number of sustaining electrodes of each group of commonly connected Y electrodes, p is 2. Therefore, in the viewpoint of the third and fourth embodiments, by the relation of q=k×p between the number of sustaining electrodes of each group of commonly connected Y electrodes, p and the number of common electrodes of each group of commonly connected X electrodes, q=2×2=4. In addition, as described above, in the fifth embodiment the reason why the number of the groups of commonly connected X electrodes, j, must be an even number is the fact that when j is an odd number, two pairs of electrodes (X2 and Y2, and X8 and Y8, drawn by thicker lines) in at least one combination of the group of commonly connected X electrodes, XX2 and the group of commonly connected Y electrodes YY2 are, as shown in FIG. 20, concurrently connected undesirably.

Figure 21:
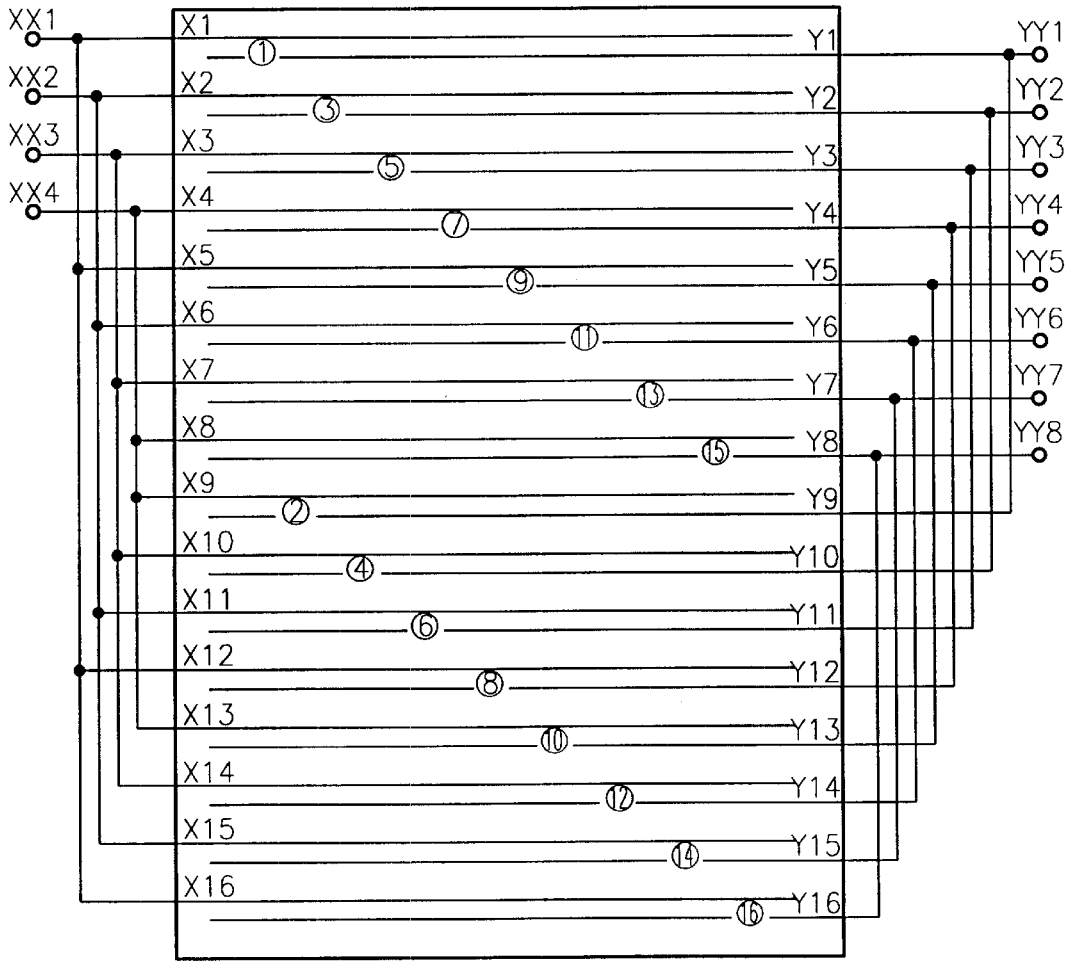
FIG. 21 is a diagram illustrating a sixth embodiment of an electrode connection scheme of an AC type plasma display panel according to the present invention.
Figure 23:
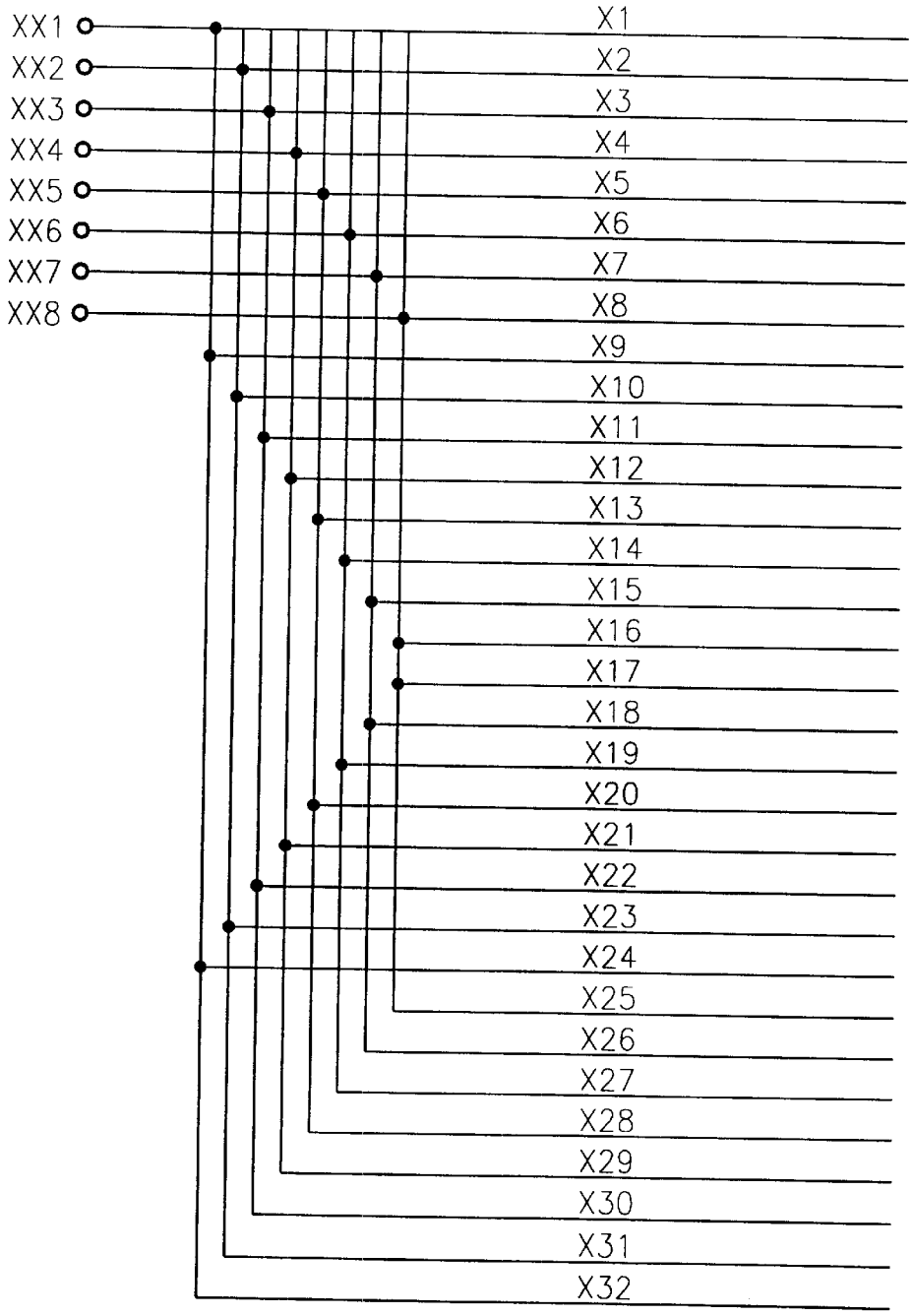
FIG. 23 is a diagram illustrating a seventh embodiment of an electrode connection scheme of an AC type plasma display panel according to the present invention.

In addition, sixth and seventh embodiments shown respectively in FIGS. 21 and 23 clearly show common electrodes commonly connected to each group of commonly connected X electrodes depending on the value of r obtained from dividing the number of groups of commonly connected X electrodes, b by 4. Namely, the sixth embodiment is the case of r=1, and the seventh embodiment is the case of r=2.

On the other hand, the driving methods of the fifth, sixth and seventh embodiments having the electrode connection schemes as described above are as follows.

Figure 19:
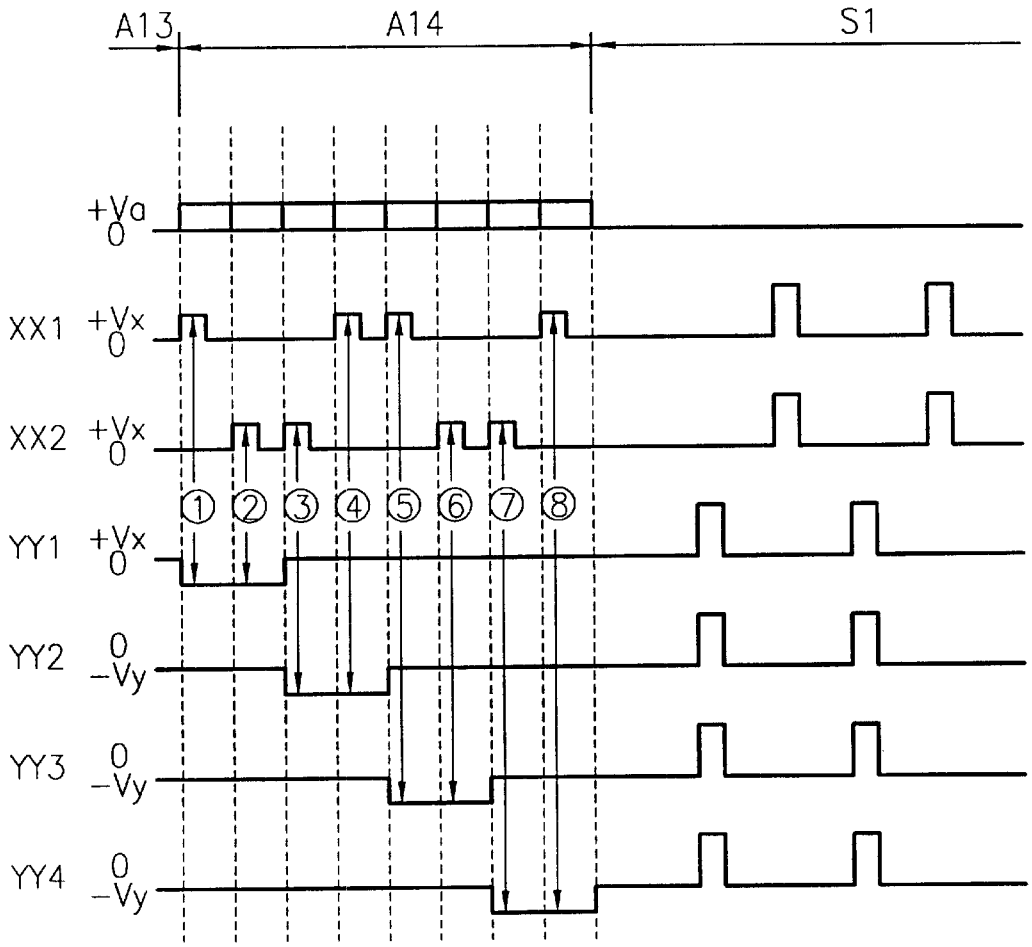
FIG. 19 is a diagram illustrating the waveforms of driving signals respectively impressed to the electrodes of the AC type plasma display panel, connected as shown in FIG. 18.
Figure 22:
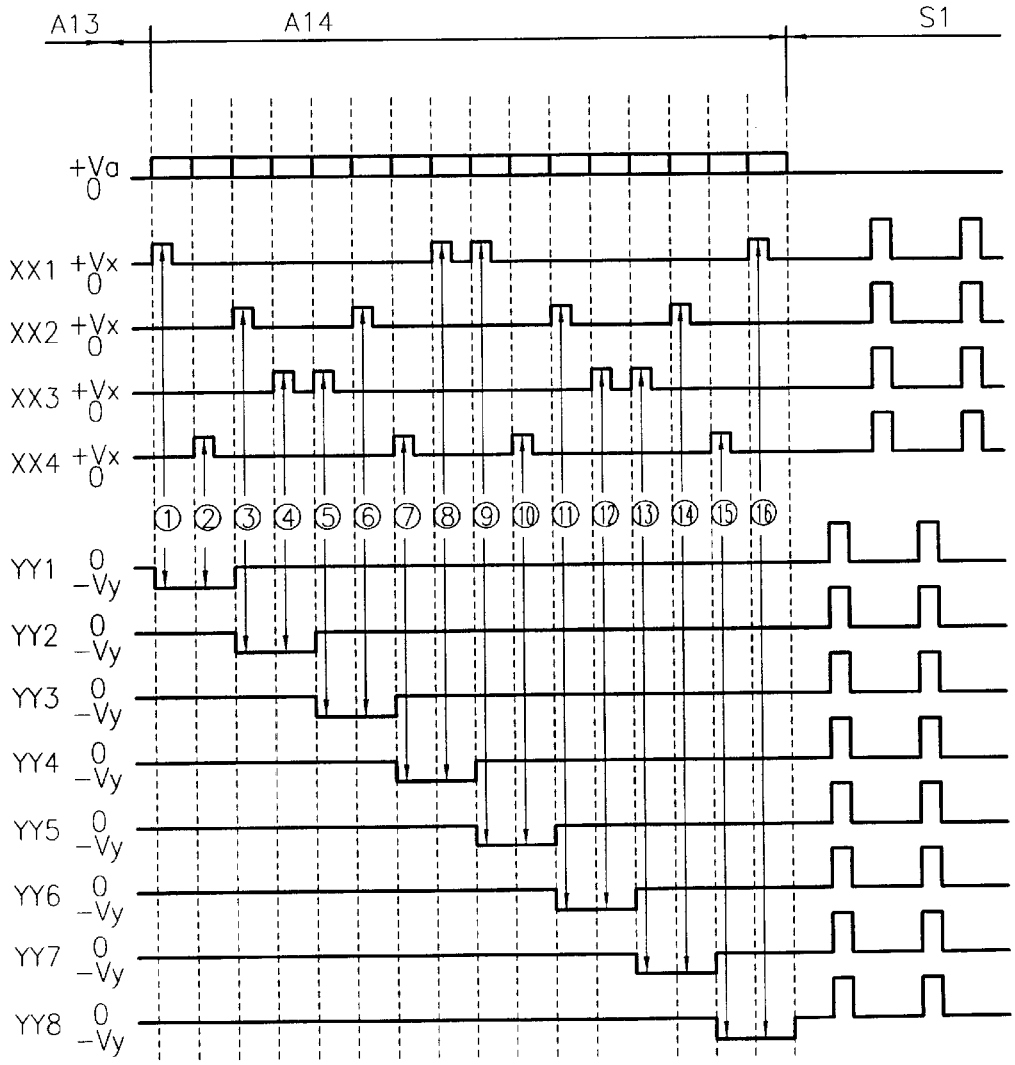
FIG. 22 is a diagram illustrating the waveforms of still another driving signals respectively impressed to the electrodes of the AC type plasma display panel, connected as shown in FIG. 21.

The scanning sequence of the fifth embodiment is similar to that of the fourth embodiment shown in FIG. 16, and in this case the influence of crosstalks by the leakage of the space charge is diminished by disposing scan electrodes concurrently impressed with voltage signals to be relatively far apart. For this purpose, in the fifth embodiment, as shown in FIG. 18, Y electrodes in different blocks Y1 and Y5, Y2 and Y6, Y3 and Y7, and Y4 and Y8 are connected to each other to form groups of commonly connected Y electrodes YY1, YY2, YY3, and YY4. FIG. 19 shows a diagram of waveforms of driving signals to drive the fifth embodiments, the waveforms of the driving signals have the same shape in appearance as those of FIG. 8 except that the positions of the signal pulses impressed to the groups of commonly connected X electrodes are modified somewhat. That is to say, while a second pulse of a third voltage $-V_y$ is impressed to a group of commonly connected Y electrodes, first pulses of a second voltage $+V_x$ are sequentially impressed respectively to two groups of commonly connected X electrodes XX1 and XX2, and therefore each one scanning discharge occurs respectively in the two blocks of the electrodes. Accordingly, the scan electrodes are alternately driven in the order as numbered in FIG. 18 in the two blocks of the electrodes by the driving signals (the first and second pulses) of the scan electrodes impressed in the order of ⓪, ②, ③, . . . , ⑧ as shown in FIG. 19. In addition, FIG. 22 shows a diagram of waveforms of driving signals impressed respectively to the electrodes the sixth embodiments shown in FIG. 21. Similarly, in this case, while a second pulse of a third voltage $-V_y$ is impressed to a group of commonly connected Y electrodes, first pulses of a second voltage $+V_x$ are sequentially impressed respectively to two groups of commonly connected X electrodes, and therefore the scan electrodes are alternately driven in the order as numbered in FIG. 21 in the two blocks of the electrodes by the driving signals (the first and second pulses) of the scan electrodes impressed in the order of 1, 2, 3, . . . , 16 as shown in FIG. 22. From the driving methods of the scan electrodes of the fifth and sixth embodiments as described above, the general driving methods of the groups of commonly connected Y electrodes and the groups of commonly connected X electrodes are explained as follows. In a driving method of an m×n matrix plasma display panel where an m×n matrix plasma display panel having m pairs of scan electrodes having m sustaining electrodes Y1, Y2, . . . , Ym and m common electrodes X1, X2, . . . , Xm arranged alternately and in parallel, and n data electrodes arranged to be orthogonal with respect to the m pairs of scan electrodes, is an 2m'×n matrix plasma display panel having 2 display units arranged each consist of m' pairs of scan electrodes having m' sustaining electrodes Y1, Y2, . . . , Ym' and m' common electrodes X1, X2, . . . , Xm' arranged alternately and in parallel, when sustaining electrodes and common electrodes of a first display unit of the 2 display units are expressed by Y1, Y2, . . . , Ym', and X1, X2, . . . , Xm', respectively and sustaining electrodes and common electrodes of a second display unit are expressed by Ym'+1, Ym'+2, . . . , Y2m', and Xm'+1, Xm'+2, . . . , X2m', while the sustaining electrodes of the 2 display unit are connected to each other to form groups of commonly connected Y electrodes YY1, YY2, YY3, . . . , YYi, respectively, a first group of commonly connected Y electrodes, YY1 consists of YI and Ym'+1 commonly connected thereto, a second group of the commonly connected Y electrodes, YY2 consists of electrodes Y2 and Ym'+2 commonly connected thereto, a third group of the commonly connected Y electrodes, YY3 consists of electrodes Y3 and Ym'+3 commonly connected thereto, and similarly, the Ah group of the commonly connected Y electrodes YYi consists of electrodes Ym' and Y2m' commonly connected thereto, and while the common electrodes of the 2 display unit are connected to each other to form groups of commonly connected X electrodes XX1, XX2, XX3, . . . , XXi, respectively, the number of the groups of commonly connected X electrodes, j, must an even number, a first group of the commonly connected X electrodes, XX1 consists of electrodes X1, X5, X2m'−4, and X2m' commonly connected thereto, a second group of the commonly connected X electrodes, XX2 consists of electrodes X2, X6, X2m'−5, and X2m'−1 commonly connected thereto, a third group of the commonly connected X electrodes, XX3 consists of electrodes X3, X7, X2m'−6, X2m'−2 commonly connected thereto, and similarly, jth group of the commonly connected X electrodes, XXj consists of electrodes Xj, Xj+4r, X2m'j+1−4r, X2m'j+1 commonly connected thereto where r is a quotient obtained by dividing j by 4, at first, a wall charge created at subfield during a previous step is completely erased as an initialization step, and then an address discharge is performed to select and prime a pixel corresponding to image information. At the time of the address discharge, first pulses having an amplitude of a second voltage ($+V_x$) with reference to a first voltage (0 V) of a reference voltage impressed to the scan electrodes, and a width smaller than that of the driving signal pulses ($+V_a$) of the data electrodes, are impressed alternately in sequential order and in reverse order of XX1, XXj, XX2, XX(j−1), XX3, XXj−2), . . . to the groups of commonly connected X electrodes. In addition, at the time of the address discharge, second pulses having an amplitude of a third voltage ($-V_y$) having an polarity opposite to that of the second voltage ($+V_x$) with reference to a first voltage and a width of the period for which the first pulses are impressed once respectively to the 2 groups of commonly connected X electrodes is impressed sequentially to the groups of commonly connected Y electrodes. The driving method of the seventh embodiment can be understood by the pulse impressing method as described above.

Further, in the driving method of the scan electrodes, it is preferable that a sustaining discharge stabilizing pulse of a fourth voltage having a width narrower than that of a sustaining discharge pulse is periodically impressed to the data electrodes during the sustaining discharge period. With respect to the sustaining discharge stabilizing pulse, the explanation described below concerning FIG. 25 and the eighth embodiment may be referred.

Figure 24:
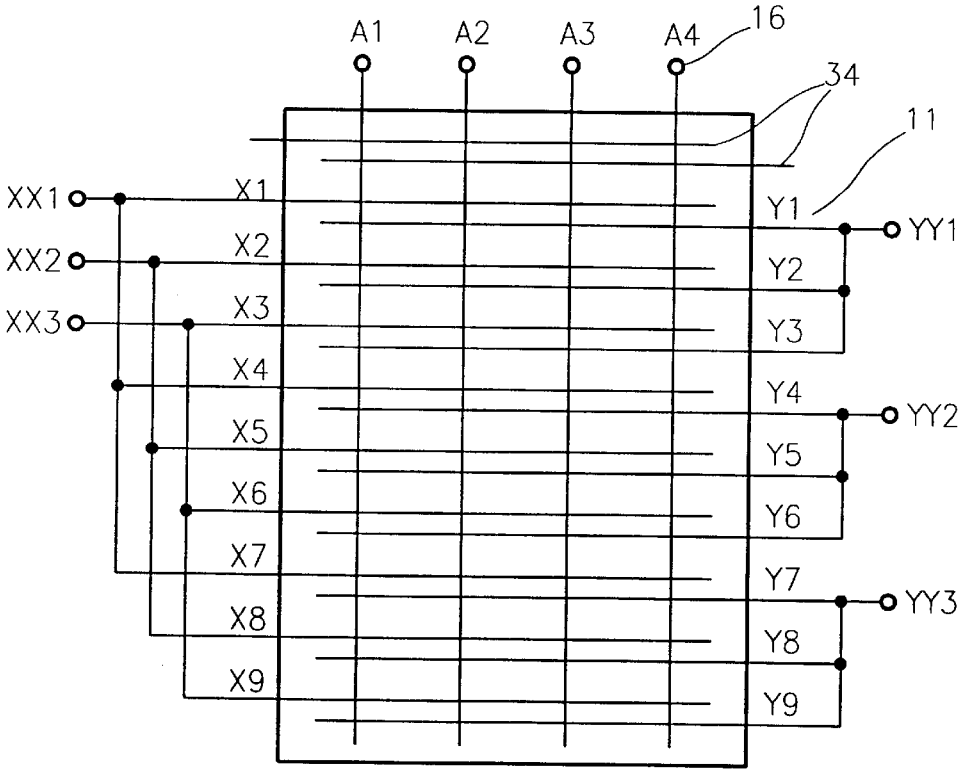
FIG. 24 is a diagram illustrating an eighth embodiment of an electrode connection scheme of an AC type plasma display panel according to the present invention.

On the other hand, FIG. 24 shows a diagram of the eighth embodiment of an electrode connection scheme of a plasma display panel according to the present invention, and in this embodiment, a preliminary discharge space and a pair of preliminary discharge electrodes 34 are provided at one side of the panel adjacent to the first pair of X and Y electrodes to facilitate the scan discharge. The preliminary discharge is generated before the first scanning discharge occurs. A wall charge created by the preliminary discharge is induced on the first pair of X and Y electrodes to facilitate the first scanning discharge. The electrode connection scheme of the eighth embodiment provided with the preliminary discharge electrodes of such a role is generally expressed as follows.

In an m×n matrix plasma display panel having m"+2 scan electrodes and n data electrodes, the 2 outmost electrodes at the one side among the m"+2 scan electrodes are provided as preliminary discharge electrodes, while the m" scan electrodes except the 2 preliminary discharge electrodes consist of pairs of m" sustaining electrodes Y1, Y2, . . . , Ym" and m" common electrodes X1, X2, . . . , Xm", the sustaining electrodes are divided into i groups of commonly connected Y electrodes (Y1, Y2, . . . , Yp), (Yp+1, Yp+2, . . . , Y2p), . . . , (Ym"−p+1, Ym"−p+2, . . . , Ym"), each group consisting of p neighboring electrodes commonly connected thereto, and the common electrodes are divided into j groups of commonly connected X electrodes, (X1, X1+j, X1+2j, . . . , Xm"−j+1), (X2, X2+j, X2+2j, . . . , Xm"−j+2), . . . , (Xj, X2j, X3j, . . . , Xm"), each group consisting of q electrodes commonly connected thereto which each are at (j+1)th position from j common electrodes at one side.

Figure 25:
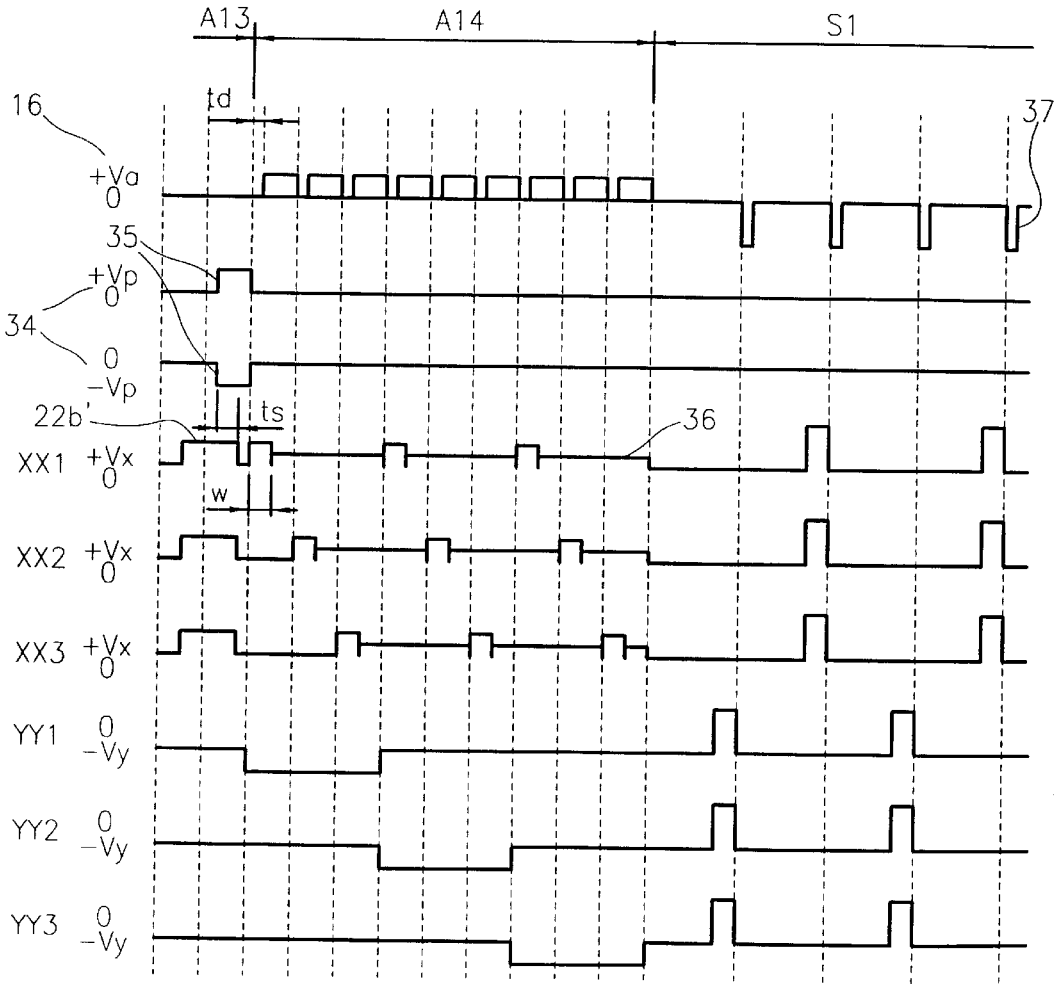
FIG. 25 is a diagram illustrating the waveforms of driving signals respectively impressed to the electrodes of the AC type plasma display panel, connected as shown in FIG. 24.

To effectively drive the eighth embodiment of such an electrode connection scheme, electrode driving signals of waveforms as shown in FIG. 25 is impressed. A method to drive the electrodes of the eighth embodiment is characterized in including a step of impressing preliminary discharge pulses 35 to the preliminary discharge electrodes 34 during a total erase period A13. In addition, it is preferable to impress further barrier voltage pulses 36 and space charge controlling pulses 37 to the groups of commonly connected X electrodes and the data electrodes respectively during an address period A14 and a sustaining display discharge period S. The barrier voltage pulses 36 maintain the selectivity of the wall charge and the space charge controlling pulses 37 are impressed as negative pulses to an address electrode 16, and control the space charge created by the sustaining discharge.

Actually, the method to drive the electrodes of the eighth embodiment is as follows.

At first, as an step to initialize the discharge space of each cell, to completely erase the wall charge in the discharge space created at the subfield in the previous step, a total erase pulse (not shown, refer to 22*a* in FIG. 5), a total write pulse (not shown, refer to 23 in FIG. 5), and a total erase pulse 22 (refer to 22*b* in FIG. 5) are sequentially impressed to the groups of commonly connected X electrodes, XX1, XX2 and XX3 and the groups of commonly connected Y electrodes, YY1, YY2 and YY3.

Next, during the initialization period the preliminary discharge pulses 35 having the same amplitudes and widths of a voltage and the polarities opposite to each other are impressed to the two preliminary discharge electrodes 34 to be overlapped with the total erase pulse 22. That the total erase pulse 22*b*' impressed to the groups of commonly connected X electrodes during the initialization period are impressed to be overlapped in a given time $t_s$ with the preliminary discharge pulses 35 is for preventing an undesirable discharge between the preliminary discharge electrodes 34 and a neighboring common electrode from occurring, and for capturing the space charge created by the preliminary discharge to the discharge space where the neighboring common electrode is. Next, the scan discharge pulses are periodically impressed to the scan electrodes to select and prime a pixel corresponding to image information. Here, first scanning discharge pulses (first pulses) having an amplitude of a second voltage ($V_x$) with reference to a first voltage (0 V)of a reference voltage impressed to the scan electrodes, and a width (w) smaller than that of the driving signal pulse of the data electrodes, are impressed sequentially to the groups of commonly connected X electrodes XX1, XX2 and XX3, and second scanning discharge pulses (second pulses) having an amplitude of a third voltage ($V_y$) having a polarity opposite to that of the second voltage ($V_x$, w) with reference to a first voltage (0 V) and a width of the period for which the first pulses are impressed once respectively to all the groups of commonly connected X electrodes, are impressed sequentially to the groups of commonly connected Y electrodes.

In the driving method of the eighth embodiment as described above, it is preferable that during the address discharge period a barrier voltage which has the same polarity of the first scanning discharge pulses ($V_x$) and is lower than the second voltage with reference to the first voltage (0 V) is impressed between the first scanning discharge pulses ($V_x$).

Further, it is also preferable that a sustaining discharge stabilizing pulse 37 of a fourth voltage having a width narrower than that of sustaining discharge pulses and a negative polarity is periodically impressed to the data electrodes during the sustaining discharge period.

The embodiments described above may employ the waveforms of the address discharge voltage and the scanning discharge voltage applied to FIGS. 11 and 12 to prevent malfunctions and to enhance the reliability of the driving result. In addition, the driving method of the plasma display panel according to the present invention can be employed in the known address display period separated driving method (the ADS driving method) or the like, and in such a case the waveforms of the fourth step according to the present invention instead of the waveforms of the fourth step, i.e., the address period in FIG. 5 are applied. In addition, the space charge can be controlled by controlling the pulse voltage of the driving signal of the X electrodes.

As described above, the plasma display panel and the method thereof according to the present invention have the advantage of saving the production cost by effectively constituting the connections of the discharge electrodes and accordingly diminishing the number of driving circuits and the number of the high voltage driving ICs of high price. In addition, the diminished number of the driving circuits begets the effect to diminish the power consumption consumed in the driving circuits of the plasma display panel and therefore to raise the efficiency of the panel. For example, in the case that the number of horizontal scanning lines is 9, the number of the driving circuits of X and Y electrodes for horizontal lines diminishes from 10 in the prior art to 6. In addition, in the case that the number of horizontal scanning lines is 480, since the possible X and Y electrode connection schemes are decided by X and Y values to satisfy the relation of X×Y=480, the electrode connection scheme to minimize the number of the driving circuits of X and Y electrodes may be achieved by 24 groups of X electrodes and 20 groups of Y electrodes. In this case, the number of required driving circuits is 44, and corresponds to 44/481 of the number of the driving circuits of the prior art, and the ratio is smaller than about one tenth. Accordingly, as described above, the production cost and the power consumption can be diminished greatly.

In addition, the fifth, sixth and seventh embodiments, since the total scan electrodes are divided into two blocks, and are driven sequentially and alternately from a block to another, the influence of crosstalks by the leakage of the space charge may be diminished by disposing scan electrodes concurrently impressed with voltage signals to be relatively far apart.

What is claimed is:

1. A driving method of a plasma display panel having m"+2 scan electrodes and n data electrodes, where while among an m×n matrix plasma display panel having m"+2 scan electrodes and n data electrodes, the 2 outmost electrodes at the one side among the m"+2 scan electrodes are provided as preliminary discharge electrodes, and while the m" scan electrodes consist of pairs of m" sustaining electrodes Y1, Y2, . . . , Ym" and m" common electrodes X1, X2, . . . , Xm", the sustaining electrodes are divided into i groups of commonly connected Y electrodes (Y1, Y2, . . . , Yp), (Yp+1, Yp+2, . . . , Y2p), . . . , (Ym"−p+1, Ym"−p+2, . . . , Ym"), each group consisting of p neighboring electrodes commonly connected thereto, and tile common electrodes are divided into j groups of commonly connected X electrodes, (X1, X1+j, X1+2j, . . . , Xm"−j+1), (X2, X2j, X2+2j, . . . , Xm"−j+2), . . . , (Xj, X2j, X3j, . . . , Xm"), each group consisting of q electrodes commonly connected thereto which each are at (j+1)th position from j common electrodes at one side, wherein the driving method includes:

an initialization step of completely erasing a wall charge created t subfield during a previous step, the initialization step comprising a step of applying preliminary discharge pulses of substantially same width, substantially same amplitude, and opposite polarity to the two preliminary discharge electrodes; and an address discharge step of selecting and priming a pixel corresponding to image information, wherein the address discharge step includes steps of:

impressing sequentially to the groups of commonly connected X electrodes first pulses having an amplitude of a second voltage with reference to a first voltage of reference voltage impressed to the scan electrodes, and a width smaller than that of the driving signal pulses of the data electrodes, and impressing sequentially to the groups of commonly connected Y electrodes second pulses having an amplitude of a third voltage having a polarity opposite to that of the second voltage with reference to a first voltage and a width of the period for which the first pulses are impressed once respectively to all the groups of commonly connected X electrodes.

2. The driving method of a plasma display panel as claimed in claim 1, wherein each pulse of the driving signal of the data electrodes is impressed later, with delay of a predetermined time, than each first pulse.

3. The driving method of a plasma display panel as claimed in claim 2, wherein the pulse of the driving signal of the data electrodes is impressed after the first pulse is impressed.

4. The driving method of a plasma display panel as claimed in claim 1, wherein the second pulse which is divided by the same width of the first pulses and is impressed to the groups of commonly connected Y electrodes during the same period to correspond to each of the first pulses.

5. The driving method of a plasma display panel as claimed in claim 1, wherein total erase pulses impressed respectively to the groups of commonly connected X electrodes in the initialization step are impressed to them to be overlapped in the width of the preliminary discharge pulse for a certain period.

6. The driving method of a plasma display panel as claimed in claim 1, wherein in the address discharge step, a barrier voltage which has the same polarity of the first pulses and is lower than the second voltage is impressed between the first pulses impressed sequentially to each of the groups of commonly connected X electrodes.

7. The driving method of a plasma display panel as claimed in claim 1, wherein a sustaining discharge stabilizing pulse of a fourth voltage having a width narrower than that of sustaining discharge pulse is periodically impressed to the data electrodes during the sustaining discharge period.

* * * * *